US009903203B2

(12) United States Patent
Shook

(10) Patent No.: US 9,903,203 B2
(45) **Date of Patent: *Feb. 27, 2018**

(54) VENTILATED MINE ROOF SUPPORT

(71) Applicant: BURRELL MINING PRODUCTS, INC., New Kensington, PA (US)

(72) Inventor: Michael T. Shook, New Kensington, PA (US)

(73) Assignee: BURRELL MINING PRODUCTS, INC., New Kensington, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/435,871

(22) Filed: Feb. 17, 2017

(65) Prior Publication Data

US 2017/0159433 A1 Jun. 8, 2017

Related U.S. Application Data

(63) Continuation-in-part of application No. 14/470,730, filed on Aug. 27, 2014, now Pat. No. 9,611,738.

(51) Int. Cl.

| | |
|---|---|
| ***E21D 15/00*** | (2006.01) |
| ***E21F 1/00*** | (2006.01) |
| ***E21D 15/48*** | (2006.01) |
| ***E21D 17/00*** | (2006.01) |

(52) U.S. Cl.
CPC ..... *E21D 17/00* (2013.01)

(58) Field of Classification Search
CPC ... E21F 1/00; E21F 1/003; E21F 1/006; E21F 1/04; E21F 1/06
USPC ..... 454/168; 52/220.8, 834
See application file for complete search history.

(56) References Cited

U.S. PATENT DOCUMENTS

| | | | |
|---|---|---|---|
| 31,777 | A | 3/1861 | Boynton |
| 82,663 | A | 9/1868 | Walters |
| 87,016 | A | 2/1869 | Walters |
| 456,646 | A | 7/1891 | Clark |
| 614,729 | A | 11/1898 | Lally |
| 881,609 | A | 3/1908 | Nellen |
| 987,397 | A | 3/1911 | Pittroff |

(Continued)

FOREIGN PATENT DOCUMENTS

| | | |
|---|---|---|
| CN | 95107473 A | 1/1996 |
| CN | 202531206 | 11/2012 |

(Continued)

OTHER PUBLICATIONS

Yield test report, conducted by NIOSH Safety Structures Testing Laboratory for Jennmar Corporation, relating to Big John Yield Props, Feb. 5, 2002, pp. 1-15.

(Continued)

*Primary Examiner* — Amber Anderson
*Assistant Examiner* — Stacy Warren
(74) *Attorney, Agent, or Firm* — Morriss O'Bryant Compagni Cannon, PLLC

(57) ABSTRACT

A longitudinally yieldable support for underground roof support includes first and second outer shell portions having a first wall thickness and a third outer shell portion having a second wall thickness that is greater than the first wall thickness. The support is filled with a solid compressible filler material. At least one air ventilation tube extends between opposite sides of the third outer shell portion to allow a flow of air through the support as the first and second outer shell portions and filler material therein yield under load.

24 Claims, 20 Drawing Sheets

(56) References Cited

U.S. PATENT DOCUMENTS

| | | | |
|---|---|---|---|
| 1,895,053 | A | 1/1933 | Staley |
| 1,971,051 | A | 8/1934 | Reiner |
| 2,508,949 | A | 5/1950 | Howard |
| 2,510,688 | A | 6/1950 | Evans |
| 3,188,041 | A | 6/1965 | Town |
| 3,196,061 | A | 7/1965 | Paulson |
| 3,648,960 | A | 3/1972 | Krekeler |
| 4,052,029 | A | 10/1977 | Townsend |
| 4,167,361 | A | 9/1979 | Petro |
| 4,185,940 | A | 1/1980 | Spies |
| 4,192,479 | A | 3/1980 | Friebe |
| 4,195,111 | A | 3/1980 | Rauten Bach |
| 4,249,837 | A | 2/1981 | Spies |
| 4,255,071 | A | 3/1981 | Koppers |
| 4,277,204 | A | 7/1981 | Koppers |
| 4,281,487 | A | 8/1981 | Koller |
| 4,309,059 | A | 1/1982 | Walsh |
| 4,332,512 | A | 6/1982 | Heintzmann et al. |
| 4,425,057 | A | 1/1984 | Hahn |
| 4,497,597 | A | 2/1985 | Chlumecky |
| 4,520,980 | A | 6/1985 | Townsend |
| 4,534,531 | A | 8/1985 | Brown |
| 4,565,469 | A | 1/1986 | Chlumecky |
| 4,664,563 | A | 5/1987 | Christman |
| 4,712,947 | A | 12/1987 | Thom |
| 4,726,714 | A | 2/1988 | MacArthur |
| 4,770,564 | A | 9/1988 | Dison |
| 4,773,792 | A | 9/1988 | Landers |
| 4,915,339 | A | 4/1990 | Halbich |
| 4,983,077 | A | 1/1991 | Sorge |
| 5,013,157 | A | 5/1991 | Mills |
| 5,015,125 | A | 5/1991 | Seegmiller |
| 5,051,039 | A | 9/1991 | Heiliger |
| 5,143,340 | A | 9/1992 | Wood |
| 5,143,484 | A | 9/1992 | Deul |
| 5,165,824 | A | 11/1992 | Corcoran |
| 5,273,378 | A | 12/1993 | Merz |
| 5,308,196 | A | 5/1994 | Frederick |
| 5,342,150 | A | 8/1994 | Kitchen |
| 5,400,994 | A | 3/1995 | Shawwaf |
| 5,413,436 | A | 5/1995 | Merz |
| 5,439,325 | A | 8/1995 | Kitchen |
| 5,669,739 | A | 9/1997 | Clarke |
| 5,720,581 | A | 2/1998 | Bacon |
| 5,772,169 | A | 6/1998 | Blockley |
| 5,868,527 | A | 2/1999 | King |
| 5,921,718 | A | 7/1999 | Kolk |
| 6,056,480 | A | 5/2000 | Kolk |
| 6,196,635 | B1 | 3/2001 | Rohaly |
| 6,394,707 | B1 | 5/2002 | Kennedy |
| 6,499,916 | B2 | 12/2002 | Marianski |
| 6,558,085 | B1 | 5/2003 | Hall |
| 6,655,877 | B2 | 12/2003 | Calhoun |
| 6,910,834 | B2 | 6/2005 | Harbaugh |
| 7,232,103 | B2 | 6/2007 | Heath |
| 7,909,542 | B2 | 3/2011 | Erasmus et al. |
| 8,052,352 | B2 | 11/2011 | Bolton |
| 8,246,276 | B2 | 8/2012 | Bower et al. |
| 8,851,805 | B2 | 10/2014 | Shook et al. |
| 2002/0136607 | A1 | 9/2002 | Merz |
| 2003/0194280 | A1 | 10/2003 | Calhoun |
| 2004/0240948 | A1 | 12/2004 | Harbaugh |
| 2007/0092344 | A1 | 4/2007 | Erasmus |
| 2011/0262231 | A1 | 10/2011 | Hussey |
| 2012/0009023 | A1 | 1/2012 | Bowler |
| 2013/0108673 | A1 | 5/2013 | McCartney |
| 2013/0149044 | A1 | 6/2013 | Barnett |
| 2014/0064859 | A1 | 3/2014 | Shook |

FOREIGN PATENT DOCUMENTS

| | | | |
|---|---|---|---|
| DE | 2410976 | | 9/1974 |
| EP | 0040096 | A1 | 11/1981 |
| EP | 0089403 | | 9/1983 |
| EP | 0128964 | A1 | 12/1984 |
| EP | 0160133 | A1 | 6/1985 |
| GB | 2070666 | A | 9/1981 |
| GB | 2081340 | A | 2/1982 |
| GB | 2125465 | A | 3/1984 |
| GB | 2149440 | A | 6/1985 |
| GB | 2330596 | A | 4/1999 |
| WO | 1995034743 | A1 | 12/1995 |
| WO | 1998050683 | A1 | 11/1998 |
| WO | 2001014692 | A1 | 3/2001 |
| WO | 2011133798 | A1 | 10/2011 |
| WO | 2012016272 | A1 | 2/2012 |
| WO | 2012056393 | A1 | 5/2012 |
| ZA | 763597 | | 6/1976 |
| ZA | 763598 | | 6/1976 |
| ZA | 775286 | | 8/1977 |
| ZA | 775348 | | 9/1977 |
| ZA | 784964 | | 3/1978 |
| ZA | 784881 | | 8/1978 |
| ZA | 785331 | | 9/1978 |
| ZA | 787331 | | 12/1978 |
| ZA | 802821 | | 5/1980 |
| ZA | 804801 | | 8/1980 |
| ZA | 805978 | | 9/1980 |
| ZA | 806817 | | 11/1980 |
| ZA | 806944 | | 11/1980 |
| ZA | 812905 | | 5/1981 |
| ZA | 814868 | | 7/1981 |
| ZA | 814869 | | 7/1981 |
| ZA | 815000 | | 7/1981 |
| ZA | 815001 | | 7/1981 |
| ZA | 815002 | | 7/1981 |
| ZA | 815085 | | 7/1981 |
| ZA | 815169 | | 7/1981 |
| ZA | 815170 | | 7/1981 |
| ZA | 836147 | | 8/1983 |
| ZA | 836286 | | 8/1983 |
| ZA | 838402 | | 11/1983 |
| ZA | 838403 | | 11/1983 |
| ZA | 847218 | | 9/1984 |
| ZA | 847219 | | 9/1984 |
| ZA | 852380 | | 3/1985 |
| ZA | 860510 | | 1/1986 |
| ZA | 860723 | | 1/1986 |
| ZA | 877215 | | 9/1987 |
| ZA | 901210 | | 2/1990 |
| ZA | 901984 | | 3/1990 |
| ZA | 910910 | | 2/1991 |
| ZA | 915093 | | 7/1991 |
| ZA | 927149 | | 9/1992 |
| ZA | 933156 | | 5/1993 |
| ZA | 934418 | | 6/1993 |
| ZA | 961864 | | 3/1996 |
| ZA | 974419 | | 5/1997 |
| ZA | 977556 | | 8/1997 |
| ZA | 978946 | | 10/1997 |
| ZA | 984887 | | 6/1998 |
| ZA | 20001460 | | 3/2000 |
| ZA | 20002789 | | 6/2000 |
| ZA | 20029937 | | 12/2002 |

OTHER PUBLICATIONS

Product information brochure produced by Burrell Mining Products International, Inc. For "The Can Cribbing System.".

Product information sheet produced by Strata Products (USA), Inc. For "Propsetter Yieldable Support System.".

VENTILATED MINE ROOF SUPPORT

CROSS-REFERENCE TO RELATED APPLICATION

The present application is a continuation-in-part of U.S. patent application Ser. No. 14/470,730 filed on Aug. 27, 2014, the entirety of which is incorporated by this reference.

BACKGROUND

Field of the Invention

The present invention relates generally to an underground mine roof support for supporting the roof, and, more particularly, to a yieldable mine roof support that allows ventilation air to pass through the mine roof support to increase air flow within a mine entry in which a plurality of the mine roof supports according to the present invention are installed.

Description of the Related Art

Over the past several years, Burrell Mining Products, Inc. of New Kensington, Pa. has successfully marketed and sold a mine roof support product sold under the trademark THE CAN®. THE CAN support is comprised of an elongate metal shell that is filled with aerated concrete. The use of aerated concrete in THE CAN support allows the support to yield axially and/or biaxially in a controlled manner that prevents sudden collapse or sagging of the mine roof and floor heaving. THE CAN support yields axially as the aerated concrete within the product is crushed and maintains support of a load as it yields.

A typical size of THE CAN support is approximately six feet (1.8 meters) in height and two feet (0.6 meters) in diameter. The overall height of THE CAN supports is based on the average size of the mine entry with each support being of a height that is less than an average height of the mine entry in which the supports are to be installed. In order to install each support, wood planks (or other appropriate cribbing materials known in the art) are placed beneath THE CAN support to level the support and additional wood planks or other cribbing materials are placed on top of the support until the space between the support and the roof is filled. Essentially, the cribbing materials are tightly wedged between the support and the roof so as to cause each THE CAN support to bear a load of the roof upon installation.

In order to adequately support the roof of a mine entry, a number of THE CAN supports are installed using the previously described method. The supports are typically installed in rows and columns according to mine engineering specifications to provide a desired level of support within the mine entry. Because a number of the supports are installed in the entry, and the fact that the supports are often staggered or offset within the mine entry, even though ventilation air can circulate around the supports, the presence of the supports within the mine entry still impedes the flow of air through the entry. Any increase in ventilation air flow is highly desired in underground mining so that fresh, breathable air is provided to mine personnel while potentially dangerous gases and airborne dust produced by general mining processes are evacuated and prevented from building within the mine atmosphere.

Thus, it would be advantageous to provide a mine roof support that is capable of supporting loads comparable to THE CAN mine roof support, but that also increases the flow of ventilation air through a mine entry in which such supports are installed. This and other advantages will become apparent from a reading of the following summary of the invention and description of the illustrated embodiments in accordance with the principles of the present invention.

SUMMARY OF THE INVENTION

Accordingly, a longitudinally yieldable support is comprised of a first outer shell portion in the form of a column comprising a first outer wall portion and having a first longitudinal axis. A second outer shell portion in the form of a column comprises a second outer wall portion and has a second longitudinal axis substantially aligned with the first longitudinal axis. A third outer shell portion in the form of a column comprises a third outer wall portion and has a third longitudinal axis substantially aligned with the first and second longitudinal axes. The third outer shell portion is interposed between the first and second outer shell portions so that the first, second and third outer shell portions are in a stacked arrangement. The outer wall of the third outer shell portion has an effective thickness that is greater than the wall thicknesses of the first and second outer wall portions. The third outer shell portion defines a first pair of apertures located along the third outer wall. The first pair of apertures are positioned on opposite sides of the third outer shell portion from one another. A first air ventilation tube having first and second ends is attached to the third outer wall and extends transversely across the third outer shell between the first pair of apertures to allow air to flow through the first pair of apertures and the first air ventilation tube. A solid compressible filler material is disposed within and substantially fills the first, second and third outer shell portions and encapsulates the first air ventilation tube within the elongate outer shell. The third outer shell portion has a wall thickness sufficient to prevent the third outer shell portion from collapsing or yielding as either of the first or second outer shell potions and associated solid compressible filler material therein yield to prevent the first air ventilation tube from collapsing or yielding, thereby maintaining a flow of air through the first air ventilation tube as the first or second outer shell portions and solid compressible filler material therein yield.

In another embodiment, the support further comprises a fourth outer shell portion in the form of a column comprising a fourth outer wall portion and having a fourth longitudinal axis substantially aligned with the first and second longitudinal axes. The fourth outer shell portion is interposed between the first and second outer shell portions so that the first, second, third and fourth outer shell portions are in a stacked arrangement. The fourth outer shell portion has an effective thickness that is greater than first or second wall thicknesses of the first and second outer wall portions, respectively. The fourth outer shell portion defines a second pair of apertures located along the fourth outer wall. The second pair of apertures is each positioned on opposite sides of the fourth outer shell portion from one another. A second air ventilation tube having first and second ends is attached to the fourth outer wall and extends transversely across the fourth outer shell portion at a location of and between the second pair of apertures to allow air to flow through the second pair of apertures and the second air ventilation tube. The first and second air ventilation tubes are arranged substantially in parallel.

In another embodiment, the third and fourth outer wall portions are integrally formed.

In still another embodiment, the first air ventilation tube is welded at its first and second ends to the third outer shell proximate the first pair of apertures and the second air ventilation tube is welded at its first and second ends to the fourth outer shell proximate the second pair of apertures.

In yet another embodiment, the first, second and third outer shell portions are comprised of steel and the solid compressible filler material is aerated concrete. The compressible filler material has a density of between about 40 and 50 lb/ft$^3$.

In another embodiment, the compressible filler material has a density of between about 50 and 60 lb/ft$^3$.

In still another embodiment, the first and second outer shell portions have substantially the same longitudinal length and the third outer shell portion is positioned approximately midway between a proximal end of the first outer shell portion and a distal end of the second outer shell portion.

In another embodiment, the first air ventilation tube is positioned approximately one third an overall length of the support from a proximal end of the elongate outer shell and the second air ventilation tube is positioned approximately one third an overall length of the elongate outer shell from a distal end of the support.

The support is capable of supporting a load of at least 100,000 lbs. Moreover, the support is capable of supporting a load of between approximately 100,000 lbs and 300,000 lbs as the support yields under load without yielding the third outer shell portion.

The first and second outer shell portions are configured to yield by folding upon themselves before the third outer shell portion yields.

In still another embodiment, the first and second outer shell portions are integrally formed to form a first continuous outer shell and the third outer shell portion forms a sleeve around and is attached to the first continuous outer shell.

In still another embodiment, the first outer shell portion is permanently attached to a first end of the third outer shell portion and the second outer shell portion is permanently attached to a second end of the third outer shell portion.

In yet another embodiment, a longitudinally yieldable support for supporting a roof in an underground mine comprises a first support section in the form of a column comprising a first outer shell of steel, a second support section in the form of a column comprising a second outer shell of steel, the first and a second support sections being substantially the same in effective diameters and lengths, and a third support section in the form of a column comprising a third outer shell of steel interposed between and permanently attached to the first and second outer shells. The third outer shell defines at least one pair of apertures, each positioned on opposite sides of the third outer shell. An air ventilation duct having first and second ends is attached to the third outer shell at a location of the pair of apertures. The air ventilation duct transversely extends across the third outer shell between the first pair of apertures. A solid compressible filler material substantially fills the first, second and third outer shells and substantially encapsulates the air ventilation duct within the third outer shell. The first air ventilation duct has a wall thickness sufficient to prevent the first air ventilation duct from collapsing or yielding as the support yields under load to maintain a flow of air through the first air ventilation duct as the support yields.

In another embodiment, the at least one pair of apertures comprises a first pair of apertures and a second pair of apertures formed in the third outer shell. The first pair of apertures are substantially vertically aligned with the second pair of apertures. Each pair of the first and second pair of apertures is positioned on opposite sides of the third outer shell from one another. A second air ventilation duct is attached to the third outer shell between the second pair of apertures. The first and second air ventilation ducts are welded at their respective ends to the third outer shell at locations of the first and second pair of apertures, respectively. The first and second outer shells are configured to fold upon themselves as the support yields while the third outer shell does not yield.

BRIEF DESCRIPTION OF THE DRAWINGS

The foregoing summary, as well as the following detailed description of the illustrated embodiments is better understood when read in conjunction with the appended drawings. For the purpose of illustrating the invention, there is shown in the drawings several exemplary embodiments which illustrate what is currently considered to be the best mode for carrying out the invention, it being understood, however, that the invention is not limited to the specific methods and instruments disclosed. In the drawings.

DETAILED DESCRIPTION OF THE ILLUSTRATED EMBODIMENTS

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention. It should be noted that there are many different and alternative configurations, devices and technologies to which the disclosed inventions may be applied. Thus, the full scope of the inventions is not limited to the examples that are described below.

Figure 1A:
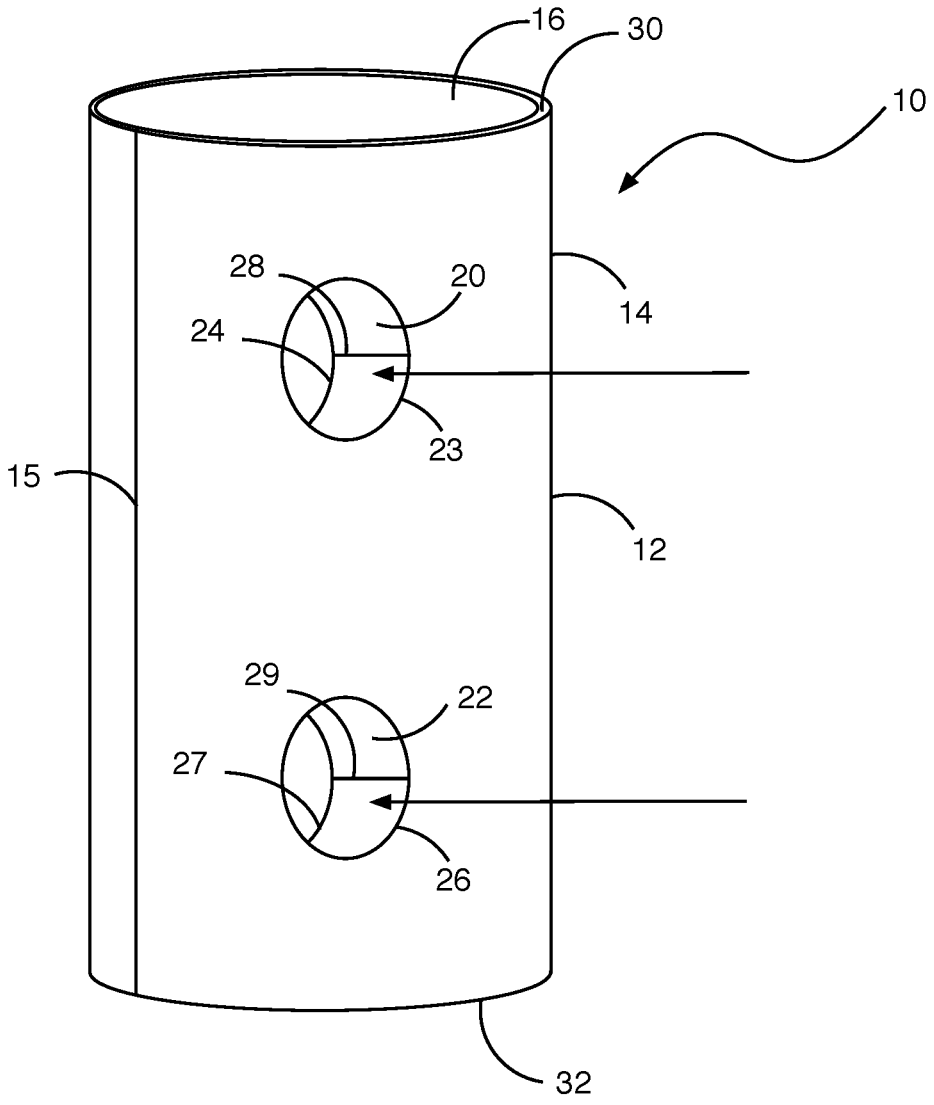
FIG. 1A is a perspective side view of a first embodiment of a support in accordance with the principles of the present invention.

FIG. 1A illustrates a first embodiment of a mine roof support in exploded form, generally indicated at 10 in accordance with the principles of the present invention. The support 10 may be utilized in various underground support situations including without limitation underground mine roof support, various tunnel applications or the like. The support 10 is comprised of a support section 12 that is comprised of an outer shell 14 in the form of a tube that is prefilled with a primary compressible filler material 16, such as an aerated concrete aerated grout, foam or other suitable material known in the art. The outer shell 14 may be comprised of a sheet of metal, such as steel, that is rolled into a cylinder and welded along a seam 15 that extends the longitudinal length of the outer shell 14. The support 10 is configured to be positioned in a desired location within a mine entry to support the roof of the mine and control convergence between the floor and the roof of the mine entry. Transversely extending tubes 20 and 22 are coupled to the outer shell 14 and extend across the support section 12. The tube 20 extends between apertures 23 and 24 formed on opposing sides of the shell 14. The tube 22 extends between apertures 26 and 27 formed on the opposing sides of the shell 14 below the apertures 23 and 24. The tubes 20 and 22 may be formed from a sheet of steel that is rolled into a cylinder shape and then welded along seams 28 and 29, respectively. Each tube 20 and 22 can then be attached to the shell 14 as by welding along the apertures 23, 24, 26 and 27, respectively. The long axis of the tubes 20 and 21 are substantially vertically aligned and substantially parallel relative to one another. The long axis of tubes 20 and 22 are also substantially horizontally oriented at right angles to the long axis of the shell 14 so that the tubes 20 and 22 transversely extend across the shell 14.

The center of the tube 20 is positioned approximately one-third the overall length of the shell 14 from the top 30 of the support section 12. The center of the tube 22 is positioned approximately one-third the overall length of the shell 14 from the bottom 32 of the support section 12. Spacing the tubes 20 and 22 the same distance from respective ends of the shell 14 allows the support 10 to be oriented in the mine entry with either end up and spaces the bottom tube 20 or 22, as the case may be depending on such orientation, so that as the support 10 yields the bottom tube 20 or 22 remains positioned above any ground water that may be present in the mine entry. It is noted that the vertical position of the tubes relative to the support can be varied based on the overall height of the support. For longer supports, the tubes can be placed closer to the center of the support or nearer the ends of the support as desired. The tubes, however, are spaced from the ends of the support to allow initial yielding of the top and/or bottom end of the support before such yielding occurs proximate the tubes as the supports tend to yield first at one or both ends of the support before yielding in the center of the support.

The shell 14 and filler material 16 work in tandem as the support 10 yields under load to allow vertical or longitudinal compression of the support 10 while maintaining support of the load. That is, the support 10 will longitudinally yield for a given displacement or yield dimension without catastrophic failure under load. In addition, the tubes 20 and 22 allow ventilation air, represented by arrows, to flow through the support 10 as the support 10 yields.

The filler material may be comprised of aerated or "foamed" concrete or cement. Use of aerated concrete is particularly beneficial because it can be cast in the outer shell 14 substantially along its entire length and the strength or compressibility characteristics of the aerated concrete is relatively uniform and predictable to produce a desired compressive strength to weight ratio. The use of aerated concrete, in which small air cells are formed within the concrete, in the support section 12 is well proven and has been reliably used in roof supports for years. In addition, once set, aerated concrete once cured forms a solidified, unitary structure that will remain contained within the outer shell 14 during handling and will not settle within the outer shell 14, as may be the case when using loose materials, such as saw dust or pumas. In a support application, settling of the filler material 16 is a major concern since any settling will result in larger displacement or yielding of the support before the support begins to carry a load. The filler material 16 is added to the shell 14 as by pouring after the tubes 20 and 22 have been secured in place in the shell 14. As the aerated concrete is poured into and fills the shell 14, the aerated concrete flows around the outside of each tube 20 and 22. Once cured, the aerated concrete 16 holds each tube 20 and 22 in place. In addition, the aerated concrete 16 provides lateral support to the tubes 20 and 22 as they are subjected to pressure as the support 10 yields to resist collapse of the tubes 20 and 22. By using an aerated concrete, the filler material is not susceptible to shrinkage and thus will continue to support the roof even after long periods of time.

Figure 1B:
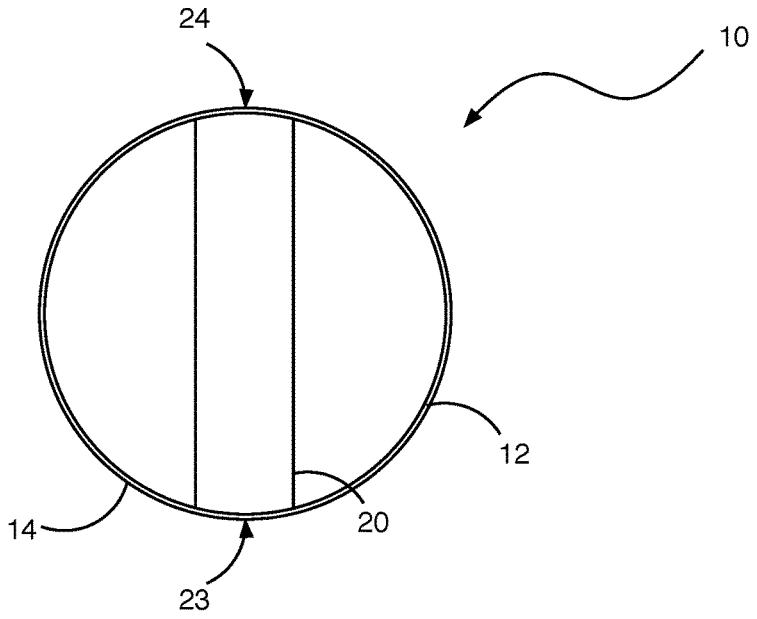
FIG. 1B is a top view of the support shown in FIG. 1A.
Figure 1C:
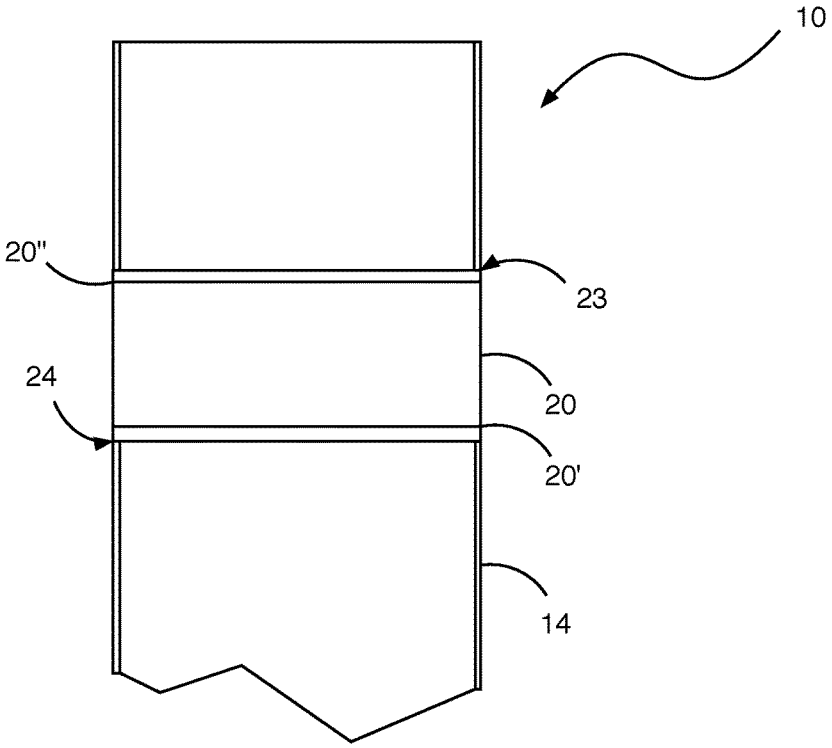
FIG. 1C is a partial cross-sectional side view of the support shown in FIG. 1A.

As shown in FIGS. 1B and 1C, each tube, such as tube 20, diametrically extends across the shell 14 of support section 12 between apertures 23 and 24. The tube 20 may have a length substantially equal to a diameter of the shell 14 so that the ends of the tube 20 are positioned proximate the outer surface of the shell 14 at the apertures 23 and 24. In this position, the ends 20' and 20" of the tube 20 can be welded to the shell 14 around each respective aperture 23 and 24. Thus, the outer diameter of the tube 20 is approximately equal to an just slightly smaller than the diameters of the apertures 23 and 24 to allow the tube 20 to be inserted through the apertures 23 and 24 and welded to the shell 14.

Figure 2A:
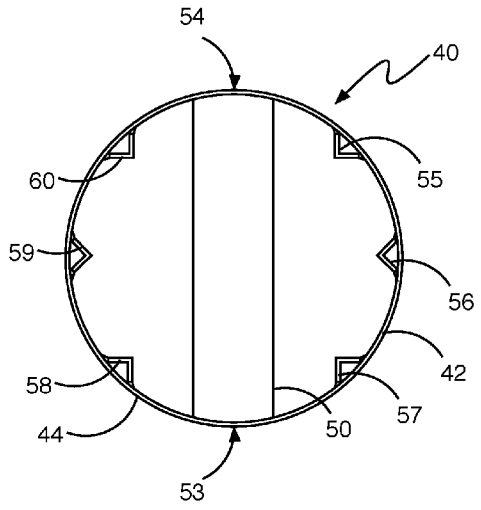
FIG. 2A is a top view of a second embodiment of a support in accordance with the principles of the present invention.
Figure 2C:
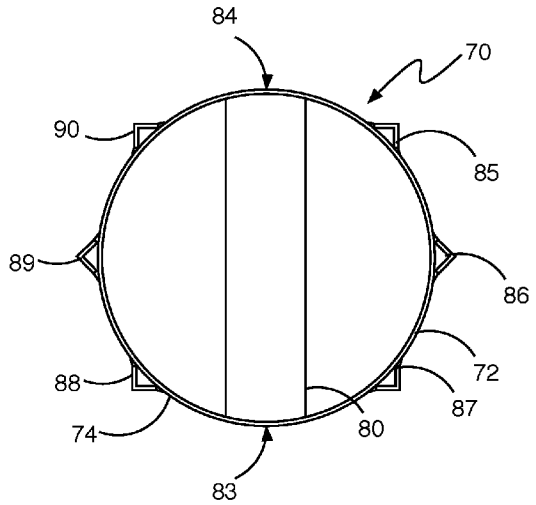
FIG. 2C is a top view of a third embodiment of a support in accordance with the principles of the present invention.
Figure 2B:
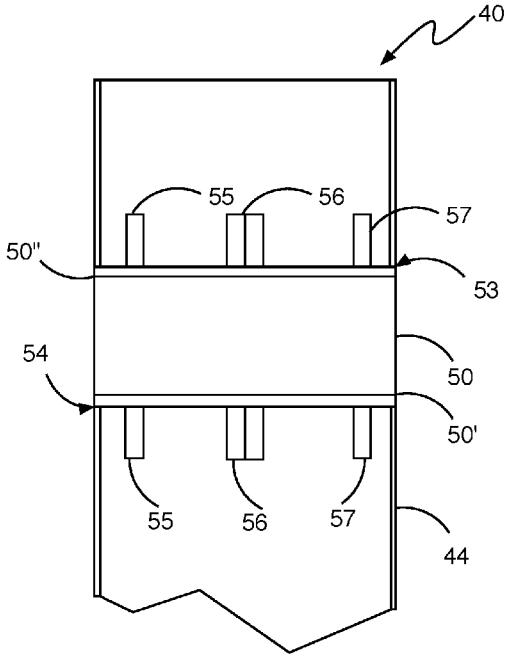
FIG. 2B is a partial cross-sectional side view of the support shown in FIG. 2A.

As shown in FIGS. 2A and 2B, a support, generally indicated at 40, is configured similarly to the support 10 illustrated in FIG. 1A, having each tube, such as tube 50, diametrically extending across the shell 44 of support section 42 between apertures 43 and 44. The tube 50 may have a length substantially equal to a diameter of the shell 44 so that the ends of the tube 50 are positioned proximate the outer surface of the shell 44 at the apertures 53 and 54. In this position, the ends 50' and 50" of the tube 50 can be welded to the shell 44 around each respective aperture 53 and 54. Thus, the outer diameter of the tube 50 is approximately equal to an just slightly smaller than the diameters of the apertures 53 and 54 to allow the tube 50 to be inserted through the apertures 53 and 54 and welded to the shell 44. In addition, positioned within the shell 44 and attached to the inner wall thereof is a plurality of stiffening members 55-60. The stiffening elements 55-60 are longitudinally aligned relative to the shell 44 and are relatively equally spaced along the inside surface of the shell 44 between the apertures 53 and 54. The stiffening elements 55-60 extend at least a diameter the tube 50. As shown, the stiffening elements 55-60 extend above and below the tube 50 so as to provide additional yield strength to the length of the shell 44 to which the stiffening elements 55-60 are attached, i.e., proximate the tube 50. The stiffening elements 55-60 may extend a few inches above and below the tube along the support 40. This added yield strength to the shell 44 in the area of the tube 50 prevents the support 40 from collapsing in the zone in which the tube 50 resides allowing the support 40 to yield in zones above and below the stiffening elements 55-60 while preventing collapse of the support 40 proximate the tube 50, which could in turn cause the tube 50 to collapse. The stiffening elements 55-60 may be formed of angled steel members (e.g., angle iron) that are welded along the edges of the stiffening elements 55-60 that are in contact with the tube 50 to secure the stiffening elements 55-60 to the tube 50 substantially along their entire length. In addition, because the stiffening elements 55-60 are attached to the inside of the support 50, the stiffening elements 55-60 are embedded within the filler material within the support 70 that helps to maintain the stiffening elements on position and also helps to prevent buckling of the stiffening elements 55-60 This ensures that the entire region of the shell 44 defined by the stiffening element 55-60 around the tube 50 is strengthened by the stiffening elements 55-60. It should be noted that while the stiffening elements 55-60 are illustrated as being formed from elongate angled members, the stiffening elements 55-60 are not limited to any particular structural shape or configuration and may include other elongate structures that can be attached to the shell 44 in order to longitudinally strengthen the shell 44 to prevent yielding in a particular area of the support 40 proximate the tube 50.

Figure 2D:
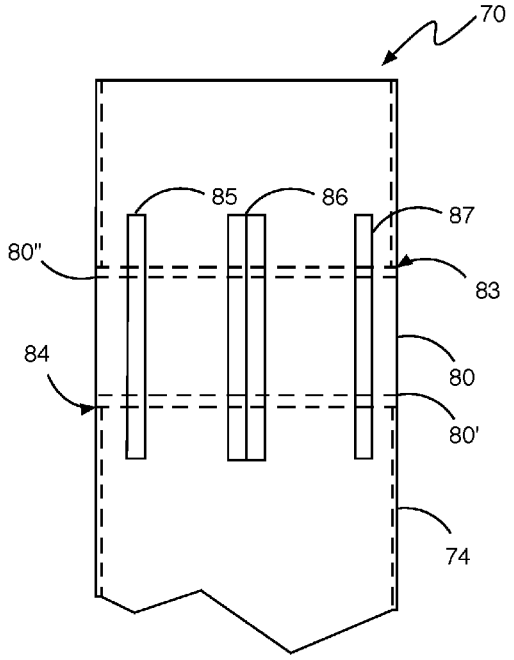
FIG. 2D is a partial cross-sectional side view of the support shown in FIG. 2C.

FIGS. 2C and 2D illustrate another embodiment of a support, generally indicated at 70, having a plurality of stiffening members 85-90 and being configured similarly to the support 40 illustrated in FIG. 1A. The support 70 includes a tube, such as tube 80, diametrically extending across the shell 74 of support section 72 between apertures 73 and 74. The tube 80 may have a length substantially equal to a diameter of the shell 74 so that the ends of the tube 80 are positioned proximate the outer surface of the shell 74 at the apertures 83 and 84. In this position, the ends 80' and 80" of the tube 80 can be welded to the shell 44 around each respective aperture 83 and 84. Thus, the outer diameter of the tube 80 is approximately equal to an just slightly smaller than the diameters of the apertures 83 and 84 to allow the tube 80 to be inserted through the apertures 83 and 84 and welded to the shell 74. In addition, positioned on the outside surface of the shell 74 and attached to the outer wall thereof is a plurality of stiffening members 85-90. The stiffening members 85-90 are longitudinally aligned relative to the shell 44 and are relatively equally spaced around the outside surface of the shell 74 between the apertures 73 and 74. The stiffening members 85-90 extend above and below the tube 80 so as to provide additional yield strength to the length of the shell 74 to which the stiffening members 85-90 are attached. This added yield strength to the shell 74 in the area of the tube 80 prevents the support 70 from collapsing in the zone in which the tube 80 resides allowing the support 70 to yield in zones above and below the stiffening members 85-90 while preventing collapse of the support 70 proximate the tube 80, which could in turn cause the tube 50 to collapse. It should be noted that such stiffening members 85-90 are also provided along the area of the support 70 in which the other tube of the support 70 resides, such as by way of example, the tube 22 shown in FIG. 1A. Again, the stiffening members 85-90 may be formed of angled steel members (e.g., angle iron) that are welded along their edges that are in contact with the outer surface of the tube 70 to secure the stiffening members 85-90 to the tube 80 substantially along their entire length. This ensures that the entire region of the shell 74 defined by the stiffening members 85-90 around the tube 80 is strengthened by the stiffening members 85-90. It should be noted that while the stiffening members 85-90 are illustrated as being formed from elongate angled members, the stiffening members 85-90 are not limited to any particular structural shape or configuration and may include other elongate structures that can be attached to the shell 74 in order to longitudinally strengthen the shell 74 to prevent yielding in a particular area of the support 70 proximate the tube 80.

Figure 3:
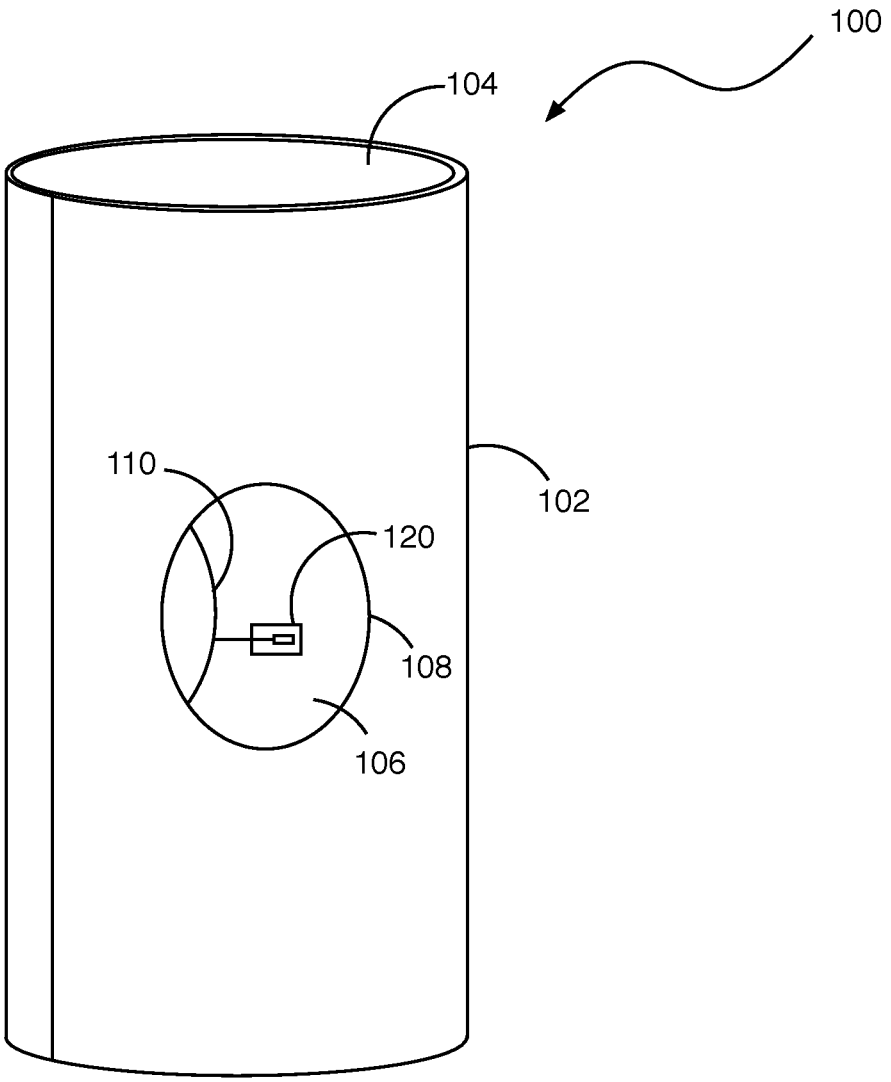
FIG. 3 is a perspective side view of a fourth embodiment of a support in accordance with the principles of the present invention.

As shown in FIG. 3, an alternative embodiment of a support, generally indicated at 100, in accordance with the principles of the present invention is illustrated. The support 100 is generally configured similarly to the support 10 with a cylindrically shaped outer shell 102 filled with aerated concrete 104. The support 100 includes a single transversely extending tube 106 that is attached to and extends through a center of the shell 102. The tube 106 is attached to the shell 102 between apertures 108 and 110 formed in the shell 102. The diameter of the tube 106 defines an area substantially equal to the combined areas defined by tubes 23 and 24 of the support 10 shown in FIG. 1A. The diameter of the tube 106 is approximately ⅓ or less the diameter of the shell 102. This allows the support 100 with a single transversely extending air duct to allow the same flow of air through the support 100 as a flow of air through the two tubes 23 and 24 of support 10 shown in FIG. 1A. For example, if the tubes 23 and 24 each have an inside diameter of 6 inches, the combined area defined by the open ends of the tubes 23 and 24 of approximately 56.52 inches squared. A single tube having an 8.5 inch inner diameter would provide substantially the same area for the flow of air through the support 100 as two 6 inch tubes.

For a predicted load carrying capacity of the support of the present invention, the air ventilation tubes (or air ducts), are configured to withstand the predicted load without crushing. Because the air ventilation tubes are encapsulated in the filler material, the filler material helps to support the sides of the air ventilation tubes as the support carries the load. Once the filler material around the air ventilation tubes is crushed, the air ventilation tubes will be subjected to the full load being carried by the support. Because a smaller diameter tube of a certain wall thickness has more load carrying capacity than a larger diameter tube of the same wall thickness, a number of smaller tubes of thinner wall section may be employed to reduce the wall thickness of each tube while the combined diameters provide sufficient air flow through the support. The required wall thickness of each air ventilation tube is dependent upon the type of steel or other material used to form each tube as well as diameter of the tube. For a 6 inch diameter steel pipe of carbon steel, the pressure to collapse the pipe is approximately 103.2 psi for a wall thickness of 0.109 inches and 315.2 psi for a wall thickness of 0.134 inches. Thus, in order to determine the size of pipe necessary to support a 200,000 pound load for a 22 inch diameter support, the pressure applied to the support under such load is the force (in pounds) divided by the area of the top surface of the support. By this calculation, the pressure of a 200,000 pound load is 526.4 psi. A 5 inch diameter carbon steel pipe having a wall thickness of 0.134 inches is predicted to collapse at 532 psi and should therefore sufficiently support a 200,000 pound load on the support without collapsing. By enlarging the diameter of the support, however, the pressure on the air ventilation tube will be lower. Thus, for the same 200,000 lb load, a 24 inch diameter support will require air ventilation tubes capable of withstanding 442 psi of pressure.

As further illustrated in FIG. 3, an air flow sensor 120 may be positioned within the tube 54 to detect air flow (e.g., cfm) through the support 100. The air flow sensor 120 may be wired or use telemetry to report air flow to a remote location. If the sensor detects a significant decrease in air flow, mine personnel can be alerted to either a malfunction of air flow equipment or a collapse of the mine entry where the air flow sensor 120 is located. The sensor 120 may also detect other atmospheric conditions in the mine entry such as the presence or levels of various gasses such as oxygen, methane, carbon monoxide, carbon dioxide and others.

Figure 4:
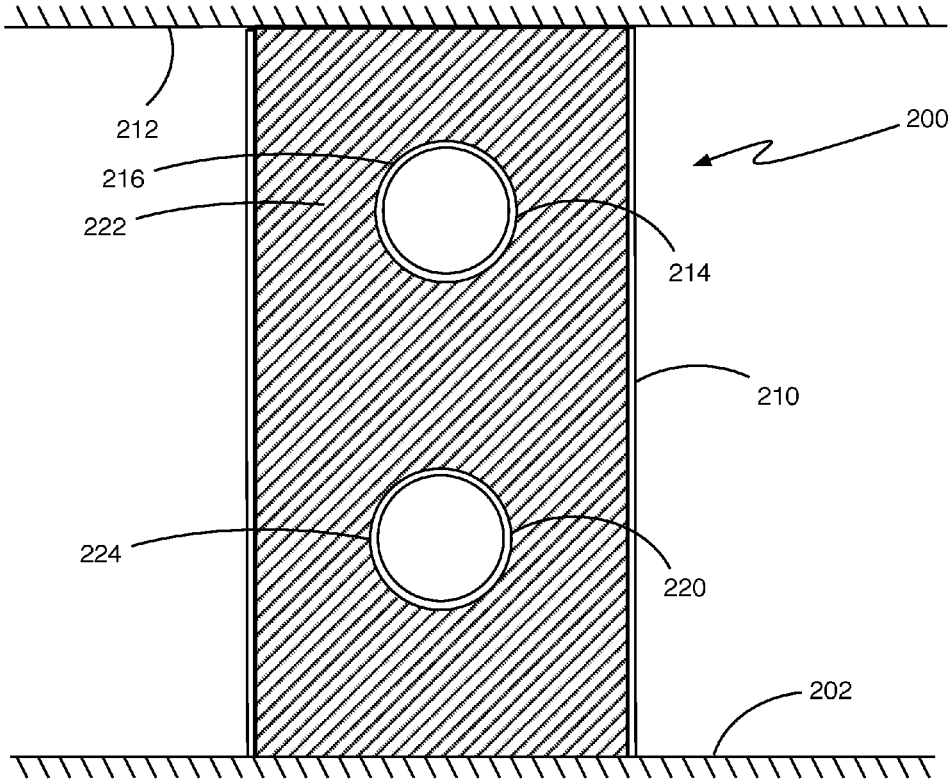
FIG. 4 is a cross-sectional side view of the support shown in FIG. 1A installed in a mine entry.
Figure 5:
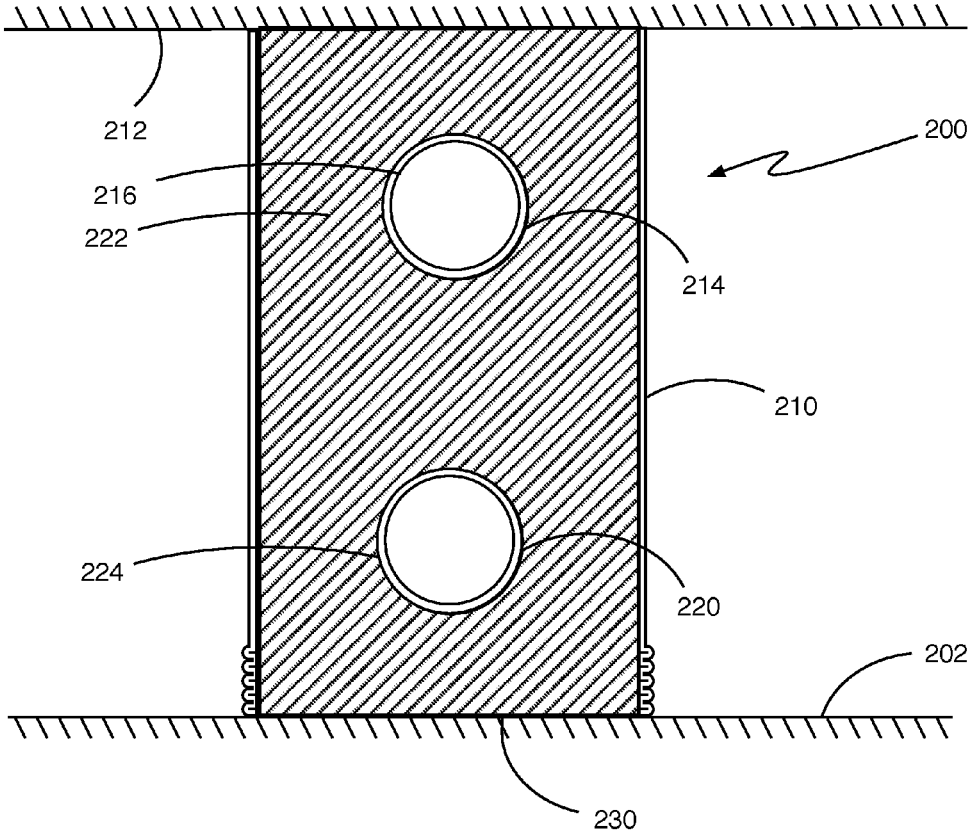
FIG. 5 is a cross-sectional side view of the support shown in FIG. 4 in a first stage of yielding.

As shown in cross-section in FIG. 4, the support 200 according to the principles of the present invention is installed in a mine entry between a floor 202 and a roof 212 of the mine. The support 200 is comprised of an outer steel shell 210 a pair of transversely extending tubes 214 and 220 that are embedded within a lightweight aerated concrete 222 that has been cast into the shell 210 and encapsulates the sides 216 and 224 of the tubes 214 and 220, respectively. As shown in FIG. 5, as the support 200 begins to yield as the floor 202 and roof 212 begin to converge, one end 230 (in this case the bottom) of the support 200 will begin to compress as the filler material 22 is crushed and the shell 210 begins to fold upon itself in an accordion-style manner due to plastic deformation of the outer shell 210 as illustrated and the filler material 222 will begin crushing to form a section of higher density filler material. In this way, the lower tube 220 is effectively moved closer to the bottom 230 of the support.

Figure 6:
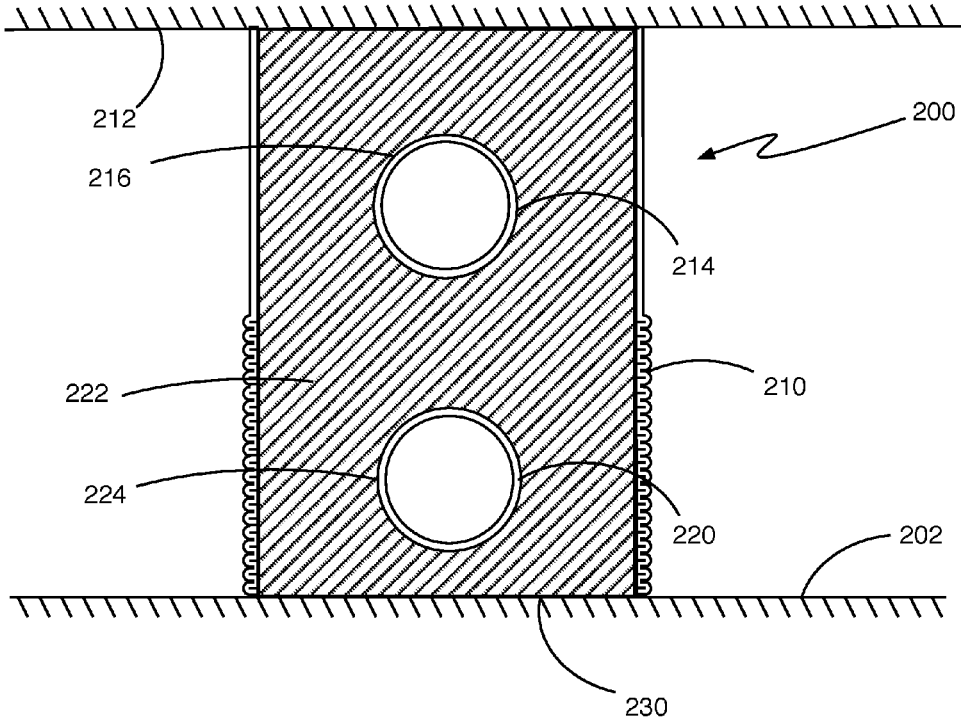
FIG. 6 is a cross-sectional side view of the support shown in FIG. 4 in a second stage of yielding.

As shown in FIG. 6, as the filler material 222 continues to compress and the shell 210 continues to fold upon itself, the tube 220 remains above the bottom surface 230 of the support 200 and thus above the floor 202 of the mine entry. The tube 220 is thus configured to withstand the load being applied to the support 200 as it is fully encased in compressed filler material 222 by residing in the portion of the support 200 that has yielded under the load. If the tube 220 were to also yield under the load, the tube 220 would collapse and flatten along its length causing the tube 220 to close.

Figure 7:
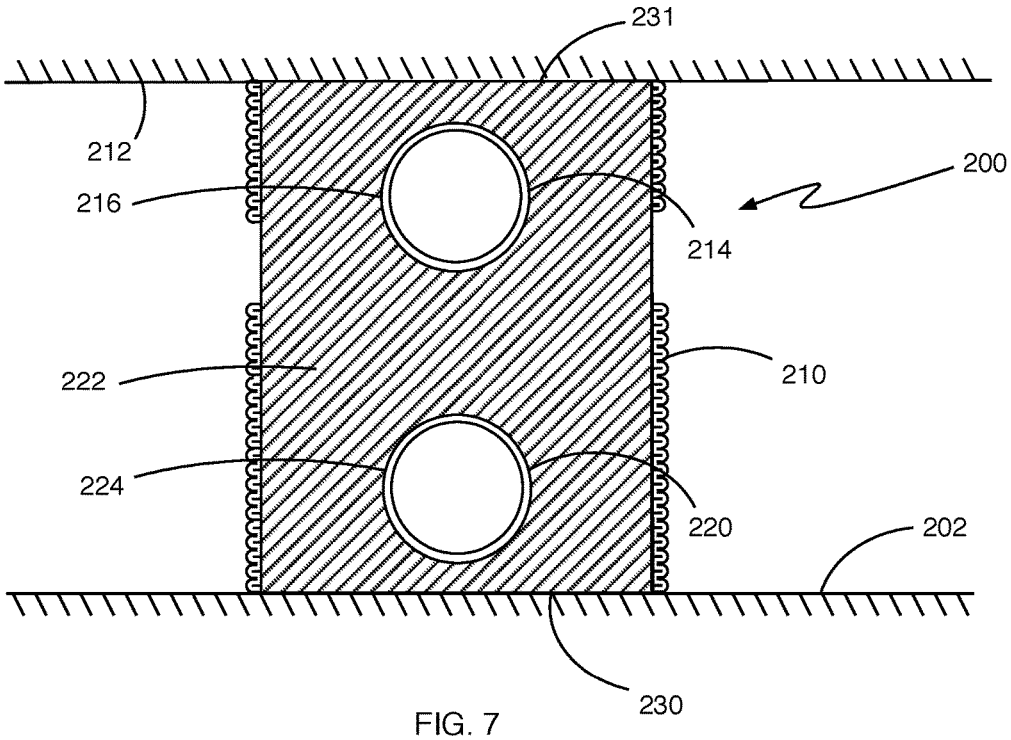
FIG. 7 is a cross-sectional side view of the support shown in FIG. 4 in a third stage of yielding.

As shown in FIG. 7, as the support 200 continues to yield, the opposite end 231, at some point, will also yield under the load in a manner similar to the end 230. That is, the lower end section will continue to yield along its length while the outer shell 210 maintains sufficient hoop strength to contain the compressed filler 222 without bulging or lateral buckling. At some point, the upper section will also begin yielding, again with the outer shell 210 folding upon itself in an accordion-style manner due to plastic deformation of the outer shell 210 as the filler material 222 crushes within the shell 210 to form a section of higher density where the support 200 has yielded. The support 200 will continue to yield until the filler material 222 is substantially fully compressed causing either the support 200 to fail or the support 200 to effectively punch through the roof 212 or the floor 202, in which case the roof 212 will collapse around the support 200. At this point, however, the support has effectively performed as expected.

As such, the tube 214 will effectively move closer to the end 231 as the surrounding filler material 222 is crushed by the load with the tube 214 bearing the weight of the load being applied without collapsing. Because the tubes 214 and 220 remain open until the support 200 has completely or nearly completely yielded, a passage defined by the tubes 214 and 220 remains open for the passage of ventilation air. This is particularly important as the supports reach the stage of yielding as shown in FIG. 7. That is, typically when the support 200 is no longer capable of yielding, the mine entry will eventually collapse around the support 200. Until complete collapse has occurred, however, even though the space between the roof 212 and floor 202 has significantly diminished and other nearby areas in the mine entry may have very well experienced some level of collapse, ventilation air can still pass through the tubes 214 and 220 of the support 200. In the case of a catastrophic and unpredicted mine roof collapse, if the supports of the present invention can continue to maintain air flow through the mine entry, the lives of any trapped miners can be saved since there is still some amount of ventilation air that can pass through the mine supports. For example, as shown schematically in FIGS. 11 and 12, when the supports 200 of the present invention are arranged in a mine entry 250 as per mining engineering specifications, the space between the supports 200, given the distance between the roof and floor of the entry 250 is typically sufficient for adequate air flow, as indicated by the arrow, (although the ventilation tubes in each support 200 enhance the flow of air through the entry 250). The supports 200 are oriented with the air ventilation tubes substantially aligned with the flow of air through the mine entry. When the floor 202 and roof 212 converge (which may be a 50% decrease in distance between the floor 202 and roof 212), however, the ventilation tubes of the supports 200 combine to provide a significantly greater proportion of the air flow through the entry 250.

Figure 8:
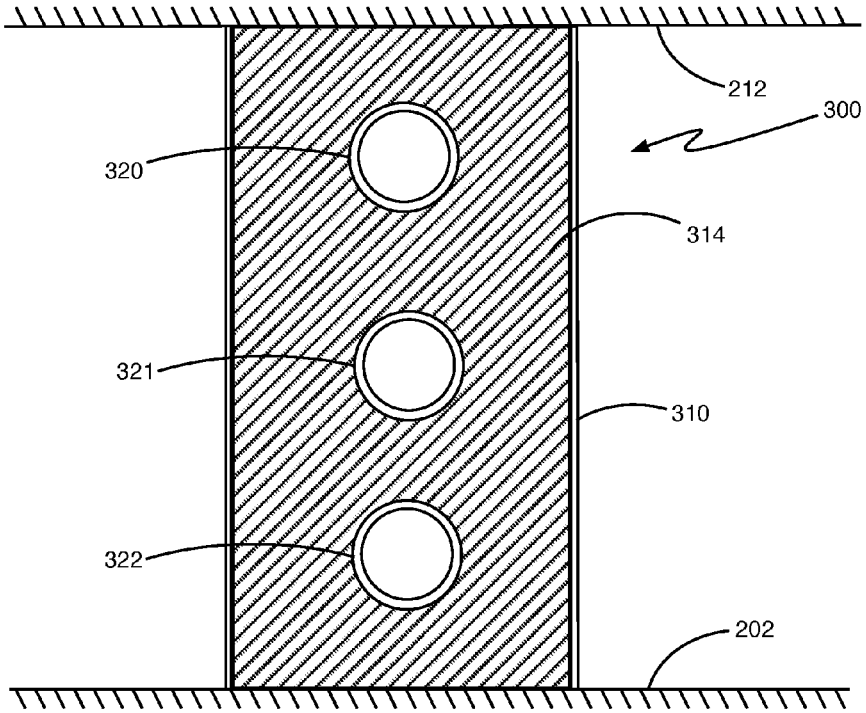
FIG. 8 is a cross-sectional side view of a fifth embodiment of a support in accordance with the principles of the present invention installed in a mine entry.
Figure 9:
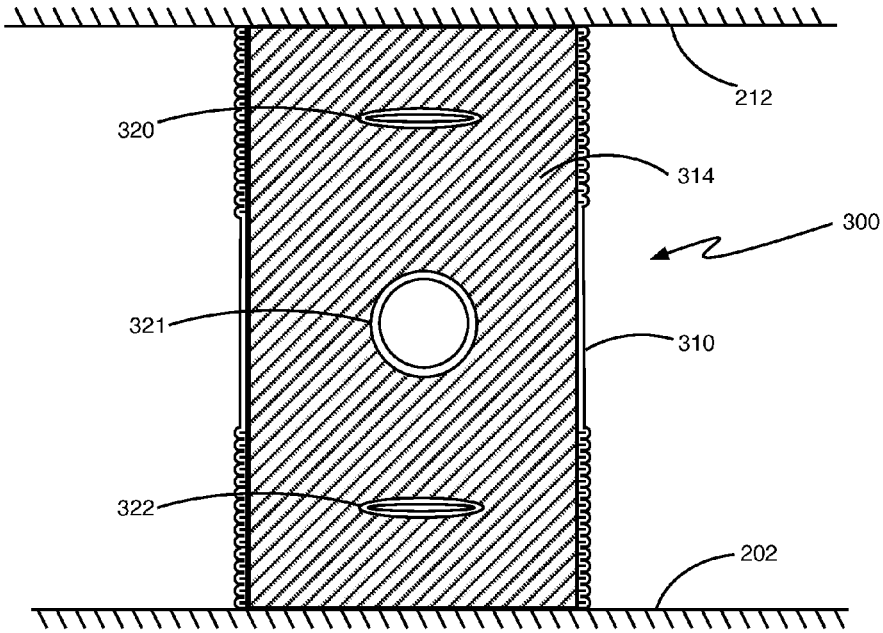
FIG. 9 is a cross-sectional side view of the support shown in FIG. 8 in a stage of yielding.

As shown in FIG. 8, yet another embodiment of a support, generally indicated at 300, in accordance with the principles of the present invention is illustrated. The support 300 is configured similarly to the support 10 illustrated in FIG. 1A with a cylindrical outer shell 310 surrounding a compressible filler material 314. The support 300 is installed in a mine entry between a floor 202 and a roof 212. The support 300 includes three air ducts 320, 321 and 322 formed from elongate metal tubes that extend through the outer shell 310 and filler material 314. The use of three tubes 320, 321 and 322 may be advantageous because the diameter of each tube 320, 321 and 322 may be made smaller. Using the same wall thickness of material for each tube as the dual tube arrangement shown in FIG. 1A allows each of the smaller tubes 320, 321 and 322 to support more load than each of the larger tubes shown in FIG. 1A. Also, as shown in FIG. 9, by providing more tubes 320, 321 and 322, if one or more tubes 320 and 322 becomes plugged or is caused to collapse, it is likely that one or more of the remaining tubes 321 will remain open to allow ventilation through the support 300. Thus, if the tubes 320 and 322 that are in the collapsed zones of the support do in fact collapse because of unexpected or excessive loads, the tube 321 will remain open to provide some ventilation through the support 300.

Figure 10:
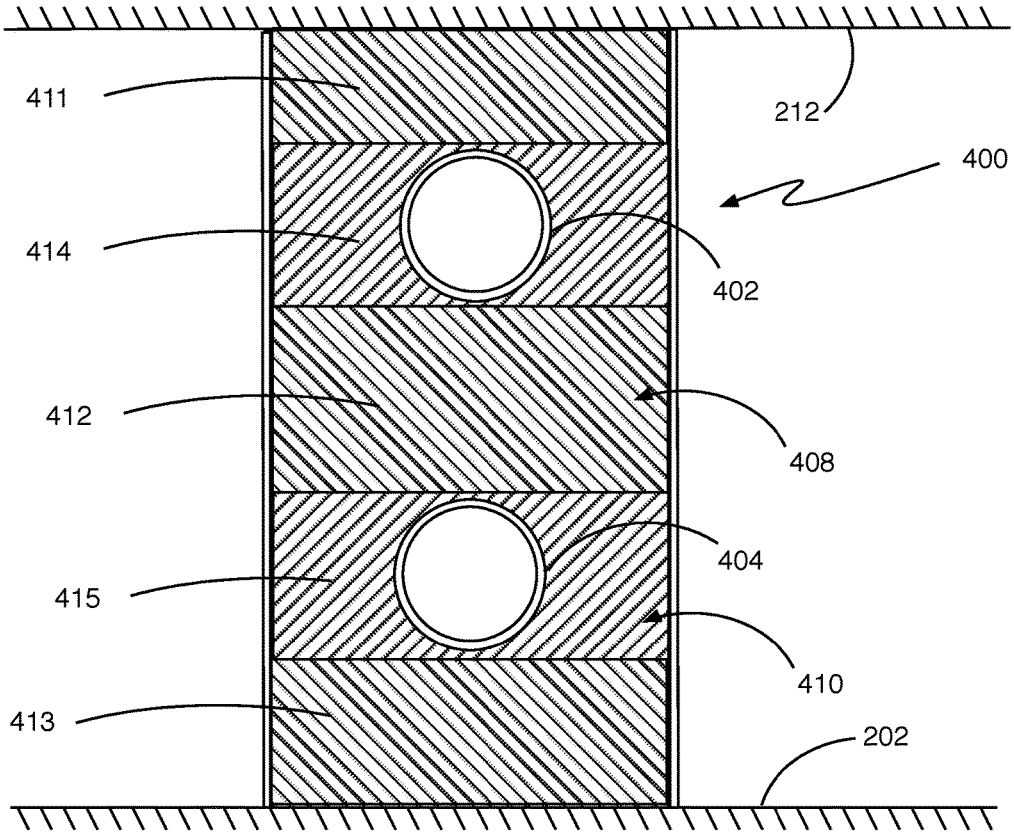
FIG. 10 is a cross-sectional side view of a sixth embodiment of a support in accordance with the principles of the present invention installed in a mine entry.

FIG. 10 illustrates yet another embodiment of a support, generally indicated at 400, in accordance with the principles of the present invention. The support 400 includes a pair of ventilation tubes 402 and 404 that extend through the body of the support 400 as previously described with reference to other embodiments herein. The filler is comprised of filler materials 408 and 410 having different densities. For example, the filler materials 408 and 410 may both be aerated concrete but of different densities. The density of the filler material 408 in the sections 411, 412 and 413 above and below the tubes 402 and 404 have a lower density than the filler material 410 in the sections 414 and 415 surrounding and encapsulating the tubes 402 and 404. As such, the sections 411, 412 and 413 will succumb to yielding before the sections 414 and 415 around the tubes 402 and 404. As such, crushing of the filler material 410 in sections 414 and 415 will occur after the filler material 408 in sections 411, 412 and 413 has been substantially crushed. Thus, the filler material 410 supports the tubes 402 and 404 within the support 400 as the support 400 yields. As a result, the tubes 402 and 404 may be formed from a thinner walled steel or other material than would otherwise be required if the filler material 410 around the tubes 402 and 404 were allowed to yield as the support 400 yields. In such a case, once the sections 411, 412 and 413 have substantially completely yielded, because the filler material 410 is also compressible, the filler material 410 and even the tubes 402 and 404 will allow the support 400 to continue to yield as it supports the roof 212 and floor 202 of the mine entry as the roof 212 and floor 202 continue to converge.

Figure 11:
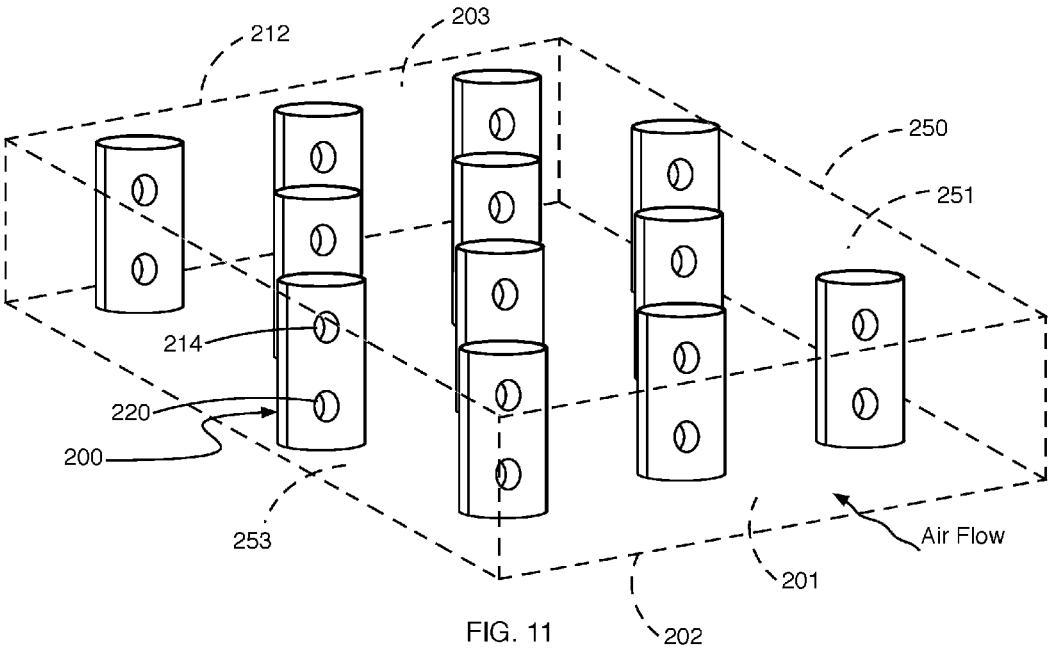
FIG. 11 perspective side view of a plurality of supports installed in a mine entry in accordance with the principles of the present invention.
Figure 12:
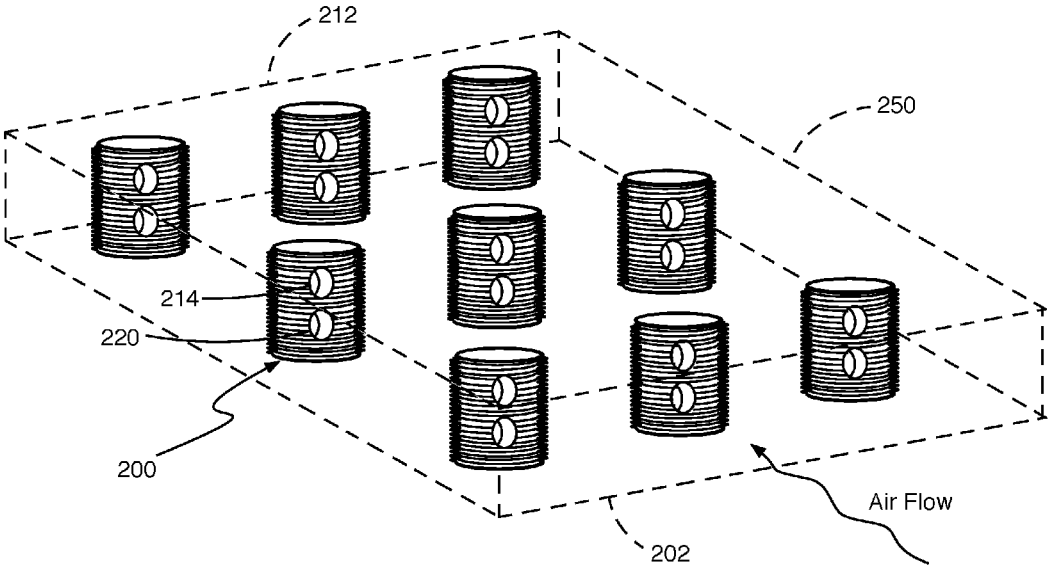
FIG. 12 perspective side view of a plurality of supports installed in a mine entry in a collapsed state in accordance with the principles of the present invention.

As shown in FIG. 11, a number of supports, such as support 200, are arranged in a mine entry 250. The supports 200 are installed between the floor 202 and roof 212 of the entry 250 and are utilized to support a particular section of the entry 250 represented by dashed lines. The left and right sides 251 and 253 of the entry 250 represent the side walls of the entry with the front 201 and rear 203 ends of the entry 250 being open to other sections of the mine. Thus, ventilation air, represented by the arrow, flows through the entry 250 from the front 201 to the rear 203. The supports 200 are oriented with the ventilation tubes 214 and 220 oriented with the longitudinal axis of the ventilation tubes 214 and 220 being generally aligned with the general direction of air flow through the entry 250, that is with the openings of the tubes 214 and 220 generally facing the front and back of the entry 250. As the floor 202 and roof 212 converge as shown in FIG. 12 and the supports 200 yield, the velocity of the air increases, as represented by the larger arrow, but the volume of air that passes through the entry 250 actually decreases due to the constriction. With the ventilation tubes 220 and 214 remaining open as the supports 200 yield, the volume of air that can pass through the entry 250 is increased by the combined area of each ventilation tube of all of the supports in the mine entry section that has experienced convergence. Thus, as the mine entry converges, the area defined by the sum of all ventilations tubes of supports 200 in that section becomes a larger percentage of the total area of through which the air can flow, thus providing increased air flow volume through the entry 250 compared to similarly sized supports without such ventilation tubes.

The supports of the present invention are designed to carry an average load of at least approximately between about 100,000 lbs and about 350,000 lbs depending on the size of the support and the initial density of the compressible filler material. For example, the compressible filler material may comprise aerated or foamed concrete, lightweight cement, grout or other material known in the art having density of approximately 40 to 50 lb/ft$^3$. For greater load carrying capability, the compressible filler material may comprise aerated or foamed concrete, lightweight cement, grout our other materials known in the art having density of approximately 50 to 60 lb/ft$^3$. The outer shell is formed by sheet rolling techniques to form a tube from a flat sheet of steel. Such steel may have a thickness of approximately 0.075 to 0.09 inches of 1008 steel. The tube is then welded at a seam along the entire length of the tube to form the cylindrical shell of the present invention. The air ducts may be formed from similar sheet rolling techniques to form a tube from a flat sheet of steel. Such steel may have a thickness of 1008 steel dependent upon the anticipated load carrying capacity of the support. The air ducts are then welded at a seam along the entire length of the air duct to form a cylinder having a length approximately equal to a diameter of the shell of the support. Likewise, steel pipe having a particular diameter and wall thickness may be used to form the outer shell or air ducts. In addition, the shell and/or air ducts may be formed by an extrusion process or other methods known in the art. The support generally will longitudinally yield when subjected to a longitudinal force or load. The support will yield in one or more yield zones by allowing the outer tube or shell to fold upon itself in a plurality of folds as the filler material compresses while the air ducts remain open as the filler material and outer shell yield around the air ducts. Thus, the support longitudinally yields without releasing the load while maintaining air flow through the support.

Various fillers and combinations of fillers may be employed in the supports. For example, the filler material may comprise aerated concrete mixtures of one or more densities. Likewise, the upper support section may include compressible fillers, such as pumas or hollow glass spheres that may be encapsulated within other binding agents or other materials, such as cement, grout or foam to hold the filler material together and to the inside of the outer shell.

Figure 13:
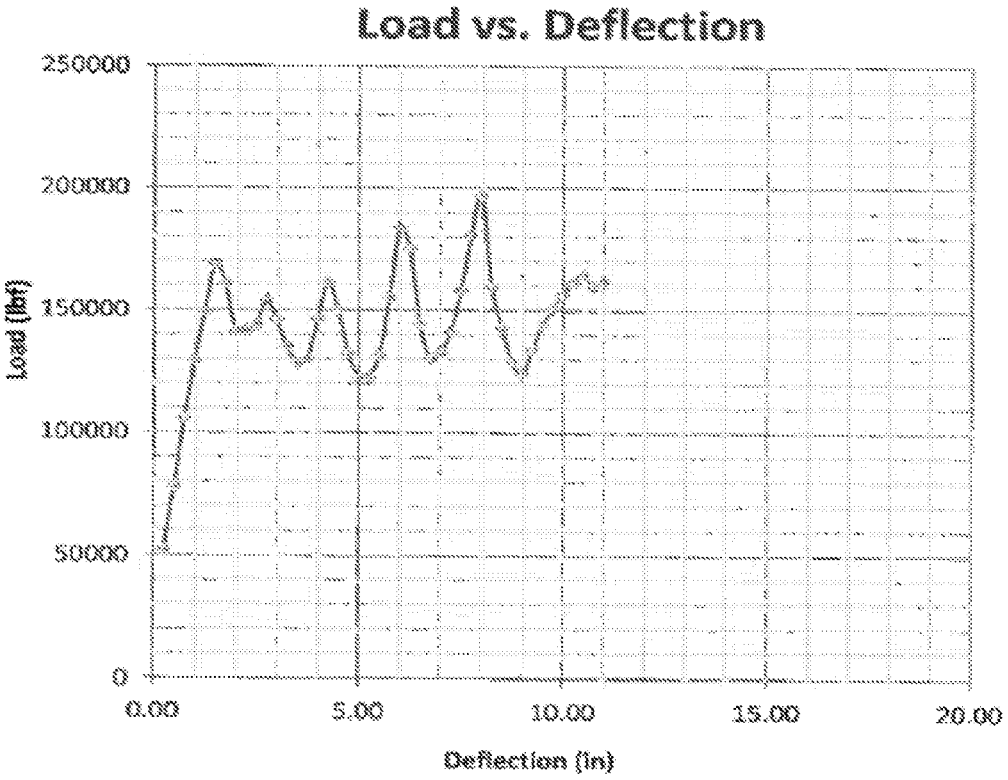
FIG. 13 is a first graphical representation of test results illustrating support load versus displacement for a support in according to the principles of the present invention.
Figure 14:
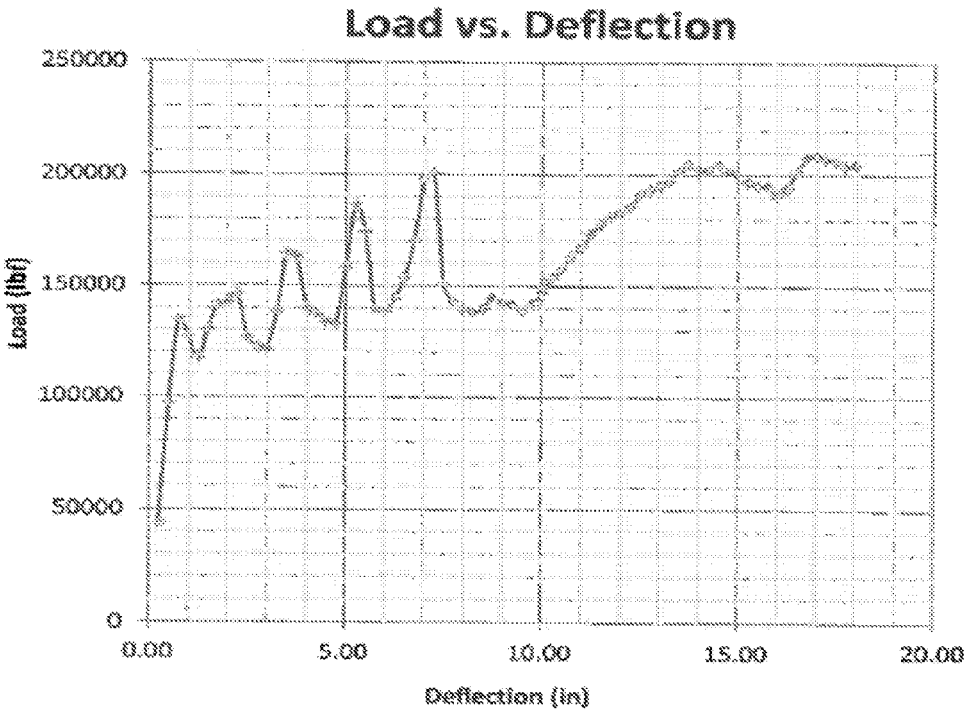
FIG. 14 is a second graphical representation of test results illustrating support load versus displacement for a support in according to the principles of the present invention.

By way of example of the loads that can be supported by a support in accordance with the present invention, several tests have illustrated the impressive load supporting capabilities of the mine support in accordance with the present invention. FIGS. 13 and 14 are graphical representations of actual test results conducted at a testing lab in Pittsburgh, Pa. FIGS. 13 and 14 illustrate load versus deflection for two tests conducted on two supports configured in accordance with the principles of the present invention. In FIG. 13, the support had a 22 inch diameter and 5 feet height with a single 6 inch diameter air duct formed from 14 gauge steel. The support maintained a maximum load capacity of approximately 200,000 lbs while experiencing 11 inches of deflection. Importantly, the support predictably maintained a load of between about 120,000 lbs to 200,000 lbs over the course of the test. The test results indicate that the support behaved predictably and in a normal manner over the range of deflection tested.

In FIG. 14, the support had a 22 inch diameter and 5 feet height with two 6 inch diameter air ducts formed from 14 gauge steel, similar to the configuration shown in FIG. 1A. The support maintained a maximum load capacity of over 200,000 lbs while experiencing 18 inches of deflection. Importantly, the support predictably maintained a load of between about 120,000 lbs to 210,000 lbs over the course of the test. The test results indicate that the support behaved predictably and in a normal manner over the range of deflection tested.

Accordingly, each test support behaved in a predictable manner that continued to yield while supporting at least a particular load. This allows mine engineers to place the supports at various locations and distances throughout a mine entry where the loads to be supported are relatively predictable. Moreover, because each support gradually increases in load bearing capacity while continuing to yield, there is no unexpected drop in load bearing capacity of the supports that could result in a localized failure. With respect to each test, the data shows a sine-type wave pattern where the load bearing capacity varies as the support is compressed. This is a result of the folding of the outer shell of the support. That is, when the outer shell of the support is experiencing plastic deformation when the shell is forming a fold, the load bearing capacity will decrease slightly until the fold is complete at which point the load bearing capacity will slightly increase. This repeats with each successive fold of the outer shell of the support until the support has reached its maximum compression (typically about half its original height). As illustrated, however, while the occurrence of each fold changes the load bearing capacity of the support, the upper and lower load bearing capacity of the support during and after a fold is within a relatively constant range, again producing a predictable load bearing capacity of the support even as the support yields.

The supports according to the present invention can also maintain a support load of even during several inches of vertical displacement of the upper end of the support relative to the bottom end. This allows the support to continue to bear a load even if the floor and roof of the mine entry laterally shift relative to one another. Thus, even in a condition where horizontal shifting of the mine roof or floor occurs, the mine support according to the present invention continues to support significant loads.

Figure 15:
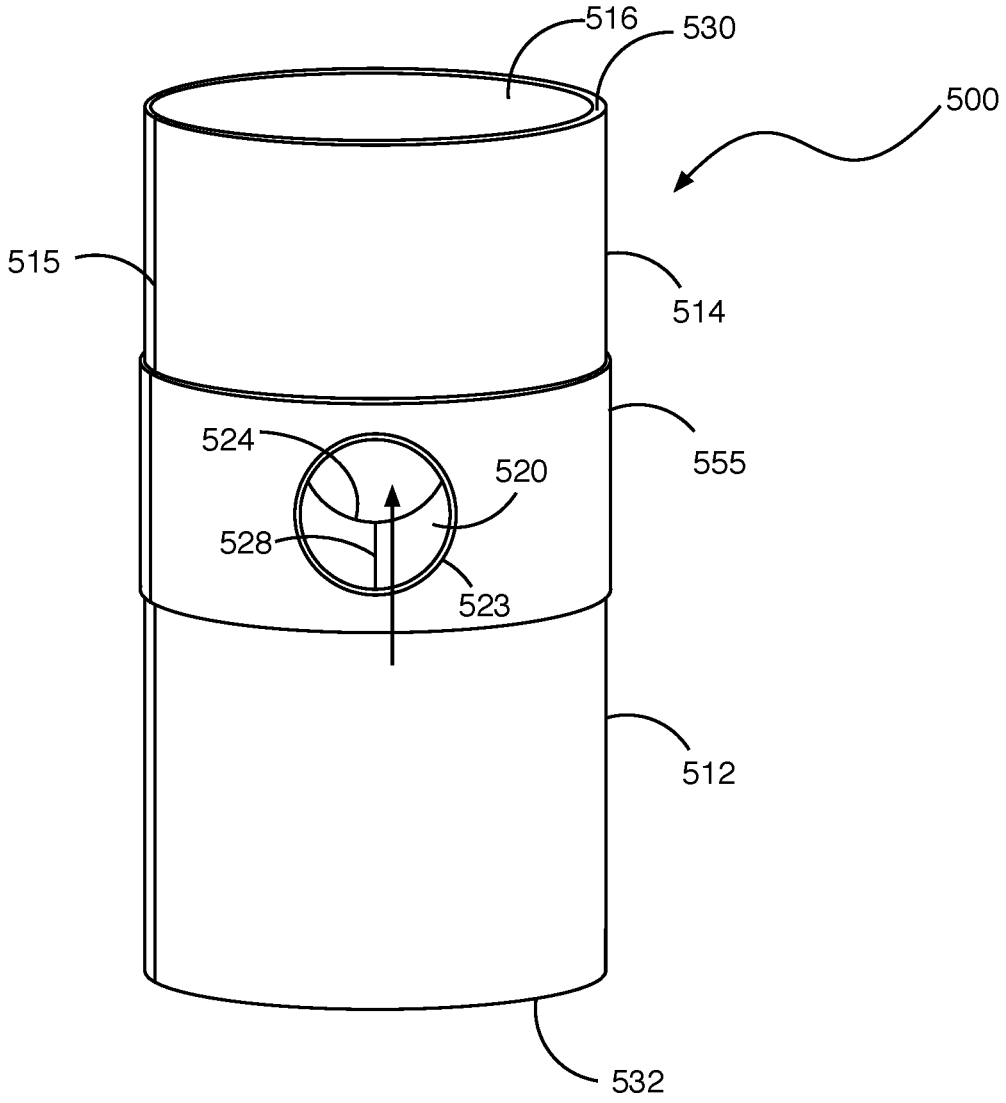
FIG. 15 is a perspective side view of a sixth embodiment of a support in accordance with the principles of the present invention.

FIG. 15 illustrates another embodiment of a mine roof support, generally indicated at 500 in accordance with the principles of the present invention. The support 500 may be utilized in various underground support situations including without limitation underground mine roof support, various tunnel applications or the like. The support 500 is comprised of a support section 512 that is comprised of an outer shell 514 in the form of a tube that is prefilled with a primary compressible filler material 516, such as an aerated concrete, aerated grout, foam or other suitable material known in the art. The outer shell 514 may be comprised of a sheet of metal, such as steel, that is rolled into a cylinder and welded along a seam 515 that extends the longitudinal length of the outer shell 514. The support 500 is configured to be positioned in a desired location within a mine entry to support the roof of the mine and control convergence between the floor and the roof of the mine entry. Transversely extending tube 520 is coupled to the outer shell 514 and extends across the support section 512. The tube 520 extends between apertures 523 and 524 formed on opposing sides of the shell 514. The tube 520 may be formed from a sheet of steel that is rolled into a cylinder shape and then welded along seam 528. The tube 520 can then be attached to the shell 514 as by welding along the apertures 523 and 524, respectively. Orienting the welded seam 528 at either the six o'clock position (i.e., bottom center portion of the aperture 523) as illustrated or the twelve o'clock position (i.e., top center portion of the aperture 523), which would be directly opposite to the seam 528 as shown on the upper portion of the tube 520 provides significantly improved strength to the tube 520 when subjected to vertical compressive forces. The long axis of the tube 520 is substantially horizontally oriented at a right angle to the long axis of the shell 514 so that the tube 520 transversely extends across the shell 514.

The center of the tube 520 is positioned approximately mid way between the ends of the shell 514. Centering the tube 520 between the ends of the shell 514 allows the support 500 to be oriented in the mine entry with either end up and spaces the tube 520 so that as the support 500 yields the tube 520 remains positioned above any ground water that may be present in the mine entry. The positioning of the tube 520 from the ends of the support 500 allows initial yielding of the top and/or bottom end of the support 500 before such yielding occurs proximate the tube 520 as the support 500 is configured to yield first at one or both ends of the support before yielding in the center of the support.

In order to prevent yielding of the support 500 proximate the tube 520 and thus to ensure that the tube 520 remains open and not collapsed as the support yields, a reinforcement or stiffening member 555 is coupled to the outer shell 514. The stiffening band or member 555 is comprised of a circumferential band having a width that is greater than a diameter of the tube 520. The stiffening band 555 may be formed from the same steel as the shell 514 so as to effectively double the wall thickness of the shell 514 around the mid-portion of the support 500. The width of the stiffening band 555 is greater than an effective diameter of the duct or tube 520 so as to increase the yield strength of the corresponding mid-portion of the support 500 to be greater than the yield strength of the upper and lower ends of the support 500 not covered by the stiffening band 555. The stiffening band 555 also defines apertures 525 and 526 that are of similar size to and aligned with the apertures 523 and 524, respectively.

The stiffening band 555 has an inner diameter that matches an outer diameter of the shell 514 and is thus longitudinally aligned relative to the shell 514. As shown, the stiffening band 555 extends above and below the tube 520 so as to provide additional yield strength to the length of the shell 514 to which the stiffening band 55-60 is attached, i.e., proximate the tube 520. The stiffening band 555 may extend a few inches above and below the tube 520 along the support 500. This added yield strength to the shell 514 in the area of the tube 520 prevents the support 500 from collapsing in the zone in which the tube 520 resides allowing the support 500 to yield in zones above and below the stiffening band 555 while preventing collapse of the support 500 proximate the tube 520, which could, without such reinforcement allow the tube 520 to collapse. The stiffening band 555 is welded along its upper and lower edges to the shell 514 to secure the stiffening band 555 to the tube 50 substantially along their entire length. This ensures that the entire region of the shell 514 reinforced by the stiffening band 555 around the tube 520 is strengthened by the stiffening band 555. It should be noted that while the stiffening band 500 is illustrated as being formed from a single band of material, the stiffening band 555 is not limited to any particular shape or configuration and may comprised of more than one element that when combined perform the same function of strengthening the shell 514 in the portion surrounding and supporting the tube 520 that can be attached to the shell 514 in order to longitudinally strengthen the shell 514 to prevent yielding in a particular area of the support 500 proximate the tube 520.

The shell 514 and filler material 516 work in tandem as the support 500 yields under load to allow vertical or longitudinal compression of the support 500 while maintaining support of the load. That is, the portions of the support 500 not reinforced by the reinforcement band 555 will longitudinally yield for a given displacement or yield dimension without catastrophic failure under load. In addition, the tube 520 continues to allow ventilation air, represented by the arrow, to flow through the support 500 as the support 500 yields.

As with other embodiments shown and described herein, the filler material may be comprised of aerated or "foamed" concrete or cement. Use of aerated concrete is particularly beneficial because it can be cast in the outer shell 514 substantially along its entire length and the strength or compressibility characteristics of the aerated concrete is relatively uniform and predictable to produce a desired compressive strength to weight ratio. The use of aerated concrete, in which small air cells are formed within the concrete, in the support section 512 is well proven and has been reliably used in roof supports for years. In addition, once set, aerated concrete once cured forms a solidified, unitary structure that will remain contained within the outer shell 514 during handling and will not settle within the outer shell 514, as may be the case when using loose materials, such as saw dust or pumas. In a support application, settling of the filler material 516 is a major concern since any settling will result in larger displacement or yielding of the support before the support begins to carry a load. The filler material 516 is added to the shell 514 as by pouring after the tube 520 has been secured in place relative to the shell 514. As the aerated concrete is poured into and fills the shell 514, the aerated concrete flows around the outside of the tube 520. Once cured, the aerated concrete 516 helps to maintain each tube 520 in place. In addition, the aerated concrete 516 provides lateral support for the tube 520 and 22 as it is subjected to pressure as the support 500 yields to resist collapse of the tube 520. By using an aerated concrete, the filler material is not susceptible to shrinkage and thus will continue to support the roof even after long periods of time.

Figure 16:
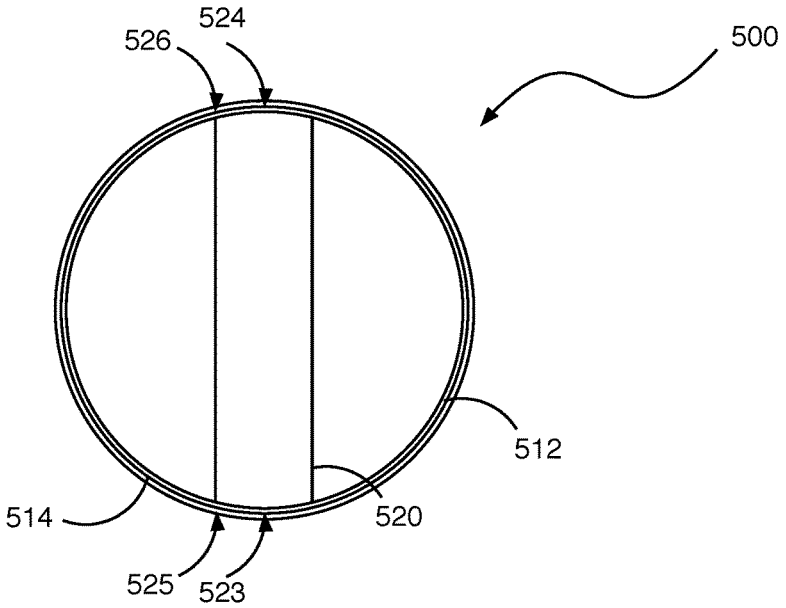
FIG. 16 is a top view of the support shown in FIG. 15.
Figure 17:
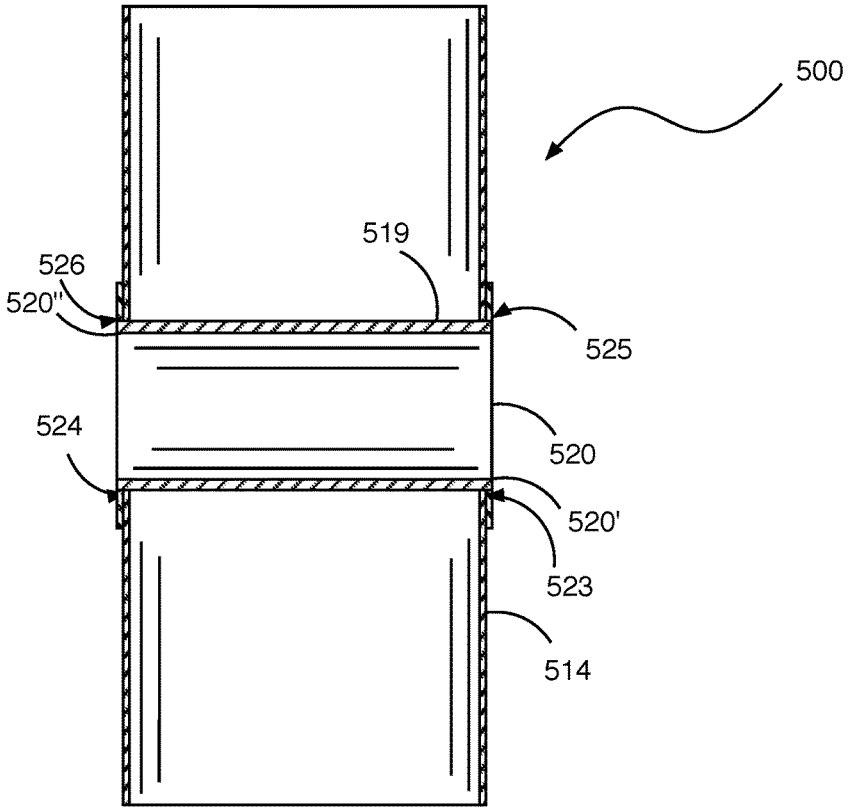
FIG. 17 is a cross-sectional side view of the support shown in FIG. 15.

As shown in FIGS. 16 and 17, each tube, such as tube 520, diametrically extends across the shell 514 of support section 512 between apertures 523 and 524 of the shell 514 and apertures 525 and 526 of the reinforcement band 555. The tube 520 may have a length substantially equal to a diameter of the shell 514 or band 555 so that the ends of the tube 520 are positioned proximate the outer surface of the shell 514 or band 555 at the apertures 523 and 524 or apertures 525 and 526. In this position, the ends 520' and 520" of the tube 520 can be welded to the shell 514 or band 555 around each respective aperture 523 and 524 and/or 525 and 526. Thus, the outer diameter of the tube 520 is approximately equal to and just slightly smaller than the diameters of the apertures 523 and 524 and apertures 525 and 526 to allow the tube 520 to be inserted through the apertures 523 and 524 and apertures 525 and 526 and welded to the shell 514 and/or the band 555.

Figure 18:
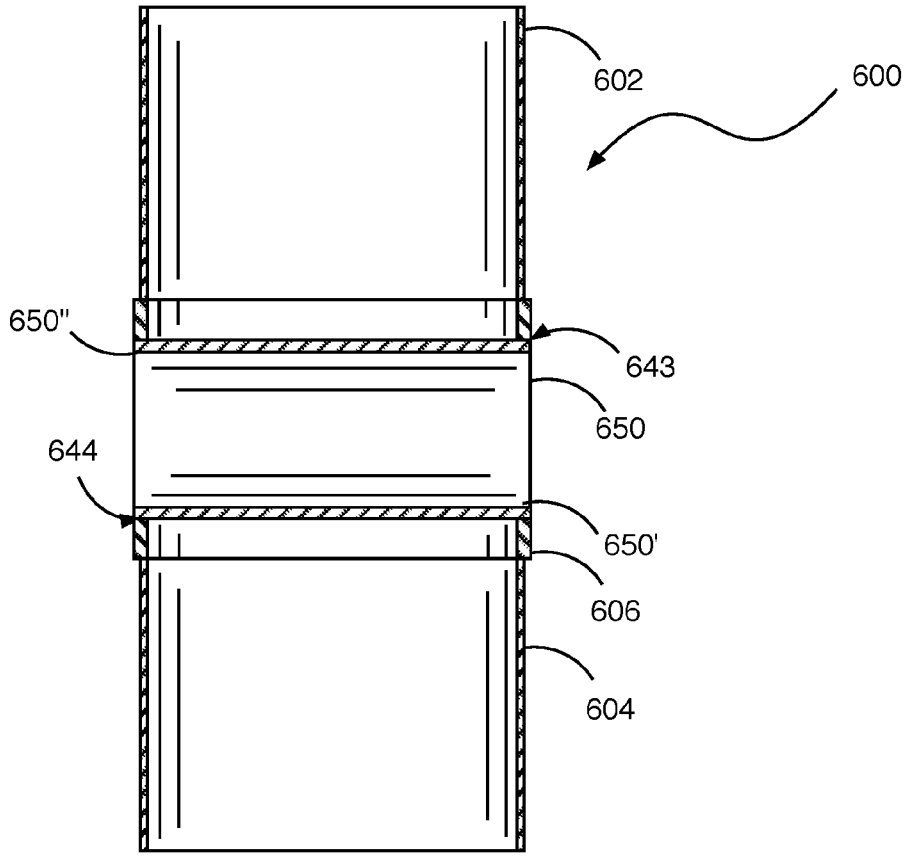
FIG. 18 is a cross-sectional side view of a seventh embodiment of a support in accordance with the principles of the present invention.

As shown in FIG. 18, a support, generally indicated at 600, is configured similarly to the support 500 illustrated in FIG. 17, but is comprised of three support sections, a first upper support section 602, a second lower support section 604 and a third centrally located reinforced support section 606. The longitudinal axes of the three support sections 602, 604 and 606 are substantially aligned such that the three sections are effectively stacked upon each other. The center section 606 has a tube, such as tube 650, diametrically extending across the reinforced support section 606 between apertures 643 and 644. The tube 650 may have a length substantially equal to a diameter of the support section 606 so that the ends of the tube 650 are positioned proximate the outer surface of the support section 606 at the apertures 643 and 644. In this position, the ends 650' and 650" of the tube 650 can be welded to the reinforced support section 606 around each respective aperture 643 and 644. Thus, the outer diameter of the tube 650 is approximately equal to and just slightly smaller than the diameters of the apertures 643 and 644 to allow the tube 650 to be inserted through the apertures 643 and 644 and welded to the reinforcement section 606. As shown, the bottom end of section 602 is welded to the top end of the reinforcement section 606 and the bottom end of the reinforcement section 606 is welded to the top end of the bottom section 604. In addition, as shown in FIG, 18, the center section 606 has side walls that are thicker than the side walls of the upper and lower section 602 and 604, respectively. This allows the upper and lower section 602 and 604 to yield before the center section 606 yields, thereby preventing collapse of the tube 650 as the support 600 yields.

Figure 19:
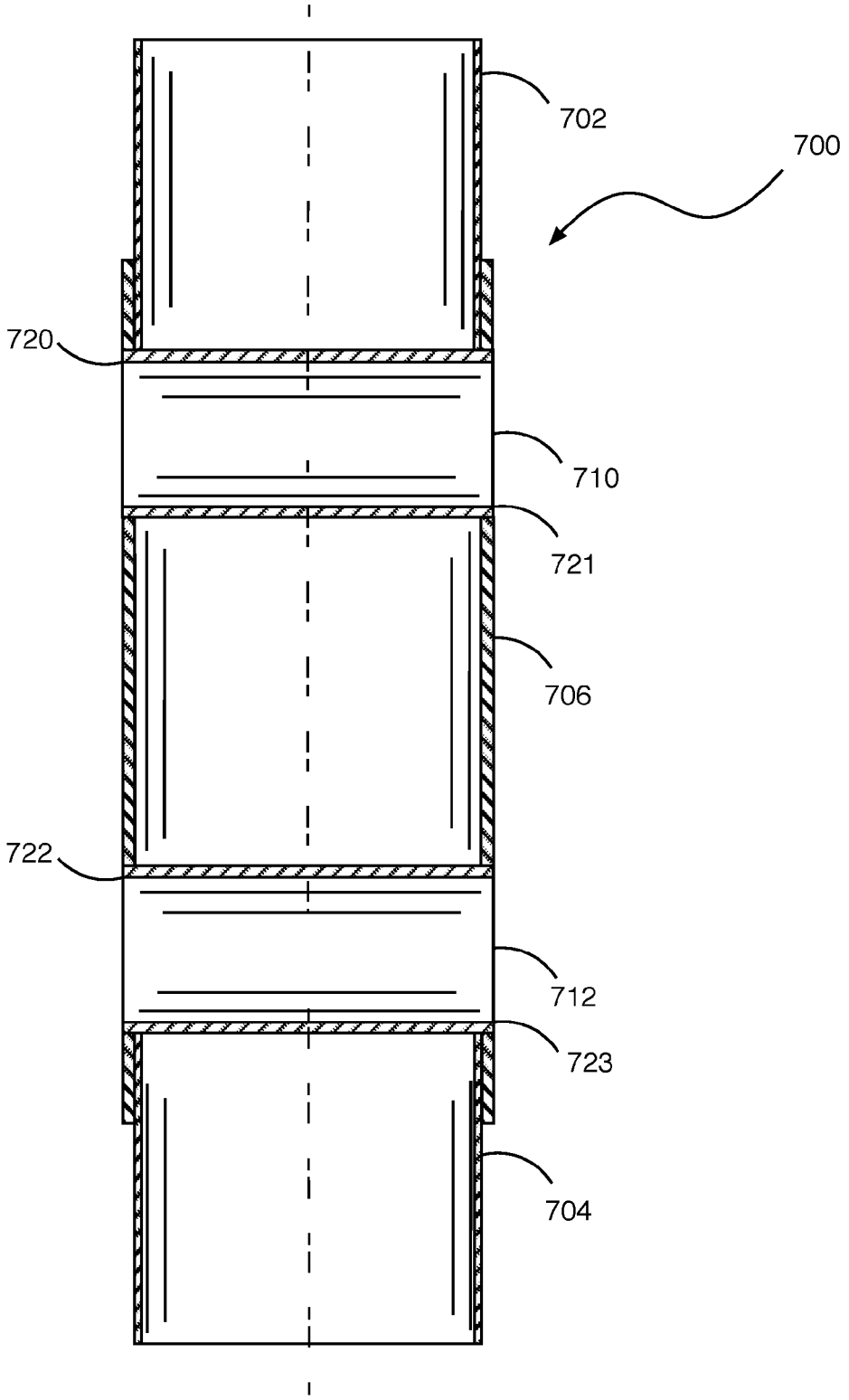
FIG. 19 is a cross-sectional side view of an eighth embodiment of a support in accordance with the principles of the present invention.

FIG. 19 illustrates another embodiment of a support, generally indicated at 700, in accordance with the present invention. The support 700 is comprised of three support sections, a first upper support section 702, a second lower support section 704 and a third centrally located reinforced support section 706. The longitudinal axes of the three support sections 702, 704 and 706 are substantially aligned such that the three sections are effectively stacked upon each other.

The upper and lower support sections 702 and 704 may have an outer diameter that is slightly smaller than an inner diameter of the center section 706 so that the upper and lower sections can fit within the top and bottom ends of the center section 706 so that they are self aligning relative to the center section 706. In this configuration, the respective longitudinal axes of each section are substantially aligned with the support sections 702, 704 and 706 in a stacked arrangement.

The center section 706 comprises a pair of ventilation tubes 710 and 712 that diametrically extend across the reinforced support section 706 between respective apertures 720-723. The tubes 710 and 712 have a length substantially equal to a diameter of the support section 706 so that the ends of the tubes 710 and 712 are positioned proximate the outer surface of the support section 706 at the apertures thereof. In this position, the ends of the tubes 710 and 712 can be welded to the reinforced support section 706 around each respective aperture. Thus, the outer diameters of the tubes 710 and 712 are approximately equal to and just slightly smaller than the diameters of the respective apertures to allow the tubes 710 and 712 to be inserted through the apertures and welded to the reinforcement section 706. If desired, the bottom end portion of section 702 may be welded to the top end portion of the reinforcement section 706 and the bottom end portion of the reinforcement section 706 may be welded to the top end portion of the bottom section 704. Likewise, the three support sections 702, 704 and 706 may be of substantially the same diameter with the bottom edge of section 706 resting upon the top edge of section 704 and the bottom edge of section 702 resting upon section 706 so that the three sections are stacked (See e.g., FIG. 20). The two resulting seams formed between each of the sections 702, 704 and 706 are then welded to form a unitary outer shell.

The center support section 706 has a wall thickness that is greater than a wall thickness of the upper and lower support sections 702 and 704 so as to prevent or resist yielding of the center section 706 prior to yielding of the upper and lower support sections 702 and 704. This prevents collapsing of the tubes 710 and 712 during yielding of the upper and lower support sections 702 and 704 support.

Figure 20:
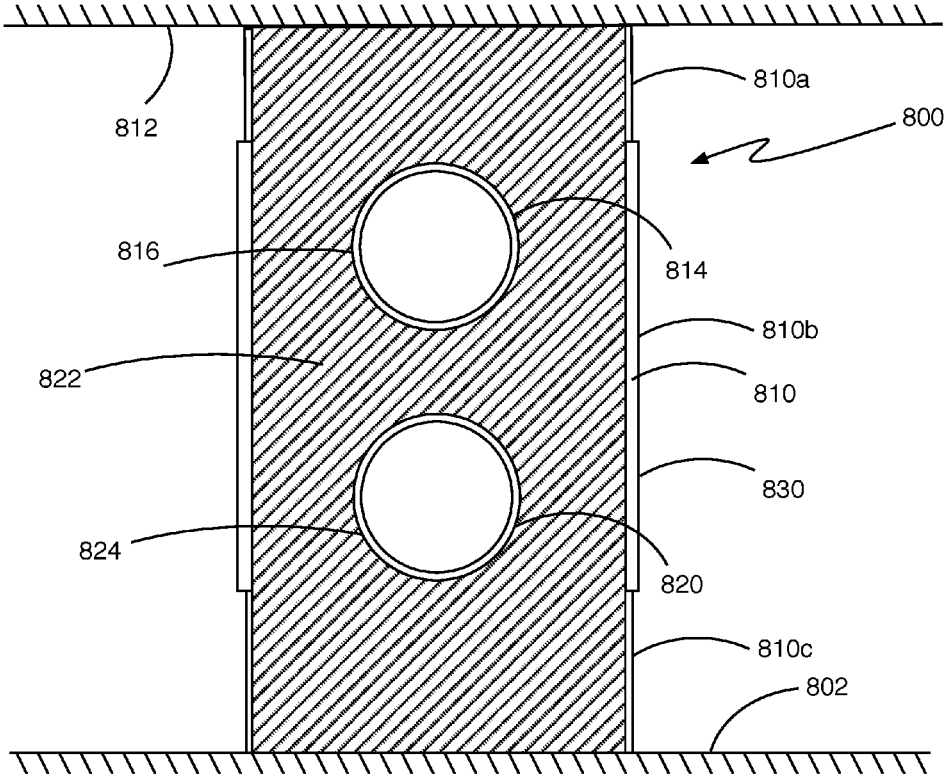
FIG. 20 is a cross-sectional side view of a support shown installed in a mine entry in accordance with the principles of the present invention.
Figure 21:
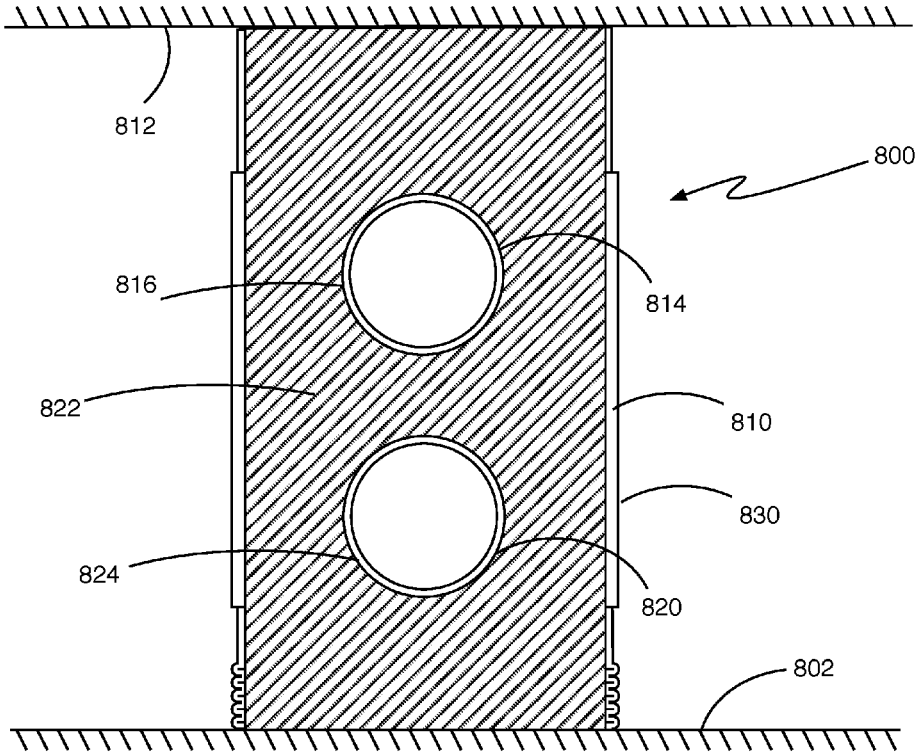
FIG. 21 is a cross-sectional side view of the support shown in FIG. 20 in a first stage of yielding.
Figure 22:
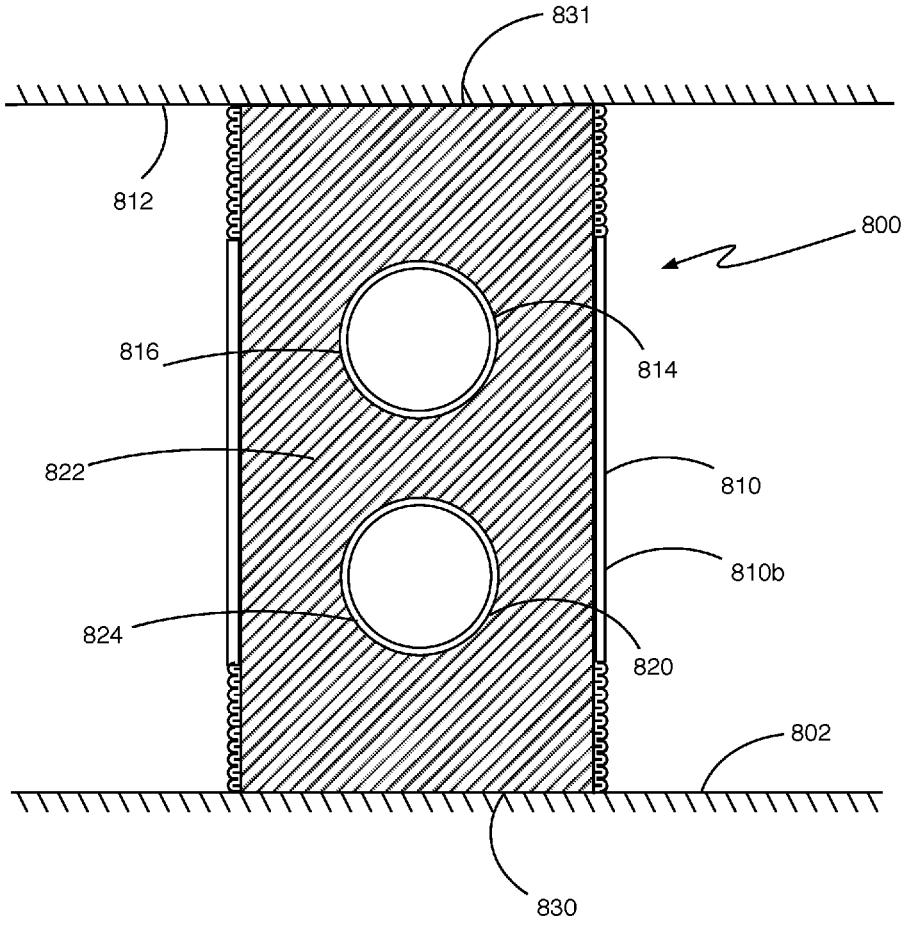
FIG. 22 is a cross-sectional side view of the support shown in FIG. 20 in a second stage of yielding.

As shown in cross-section in FIGS. 20-22, a support 800 according to the principles of the present invention is installed in a mine entry between a floor 802 and a roof 812 of the mine. The support 800 is comprised of a three piece outer steel shell 810 transversely extending tubes 814 and 820 that are embedded within a lightweight aerated concrete 822 that has been cast into the shell 810 and encapsulates the sides 816 and 824 of the tubes 814 and 820, respectively. The shell 810 is comprised of three sections 810*a*, 810*b* and 810*c* that are joined together as by welding at their respective abutting ends. As by way of example and not of limitation, for a support 800 having a length of approximately 7 feet, the upper and lower sections 810*a* and 810*c* may be approximately 1 foot each in longitudinal length with the center section 810*b* having a longitudinal length of approximately 5 feet. The center section 810*b* is formed from a rolled sheet of steel that has a thicker gauge than the upper and lower sections 810*a* and 810*c*. As shown in FIGS. 21 and 22, this causes the support 800 to begin to yield as the floor 802 and roof 812 begin to converge at one end 830 (in this case the bottom) of the support 800 as the filler material 822 is compressed and crushed and the shell 810 begins to fold upon itself in an accordion-style manner due to plastic deformation of the outer shell 810 as illustrated. During yielding of the support 800, the filler material 822 will continue to be crushed to form a section of higher density filler material. As the bottom section 810*c* yields, the lower tube 820 is effectively moved closer to the bottom 830 of the support.

As further shown in FIG. 22, as the filler material 822 continues to compress and the shell 810 continues to fold upon itself, the tube 820 remains above the bottom surface 830 of the support 800 and thus above the floor 802 of the mine entry. The reinforced center section 810*b* is thus configured to withstand the load being applied to the support 800 and thus prevent the tubes 814 and 820 from collapsing as the support 800 yields. If the tubes 814 and 820 were to also yield under the load, the tubes 814 and 820 would collapse and horizontally flatten along theirs lengths causing the tubes 814 and 820 to partially or entirely close.

As further shown in FIG. 22, as the support 800 continues to yield, the opposite end 831, at some point, will also yield under the load in a manner similar to the end 830. That is, the lower end section 810*c* will continue to yield along its length while the outer shell 810 in that region maintains sufficient hoop strength to contain the compressed filler 822 without bulging or lateral buckling. At some point, the upper section 810*a* will also begin yielding, again with the outer shell in that section folding upon itself in an accordion-style manner due to plastic deformation of the outer shell as the filler material 822 crushes within the shell to form a section of higher density where the support 800 has yielded. Once the upper and lower sections 810*a* and 810*c* are fully compressed, the center section 810*b* may then begin to yield in a similar fashion. Thus, the support 800 will continue to yield until the filler material 822 over the entire length of the support 800 is substantially fully compressed causing either the support 800 to fail or the support 800 to effectively punch through the roof 812 or the floor 802, in which case the roof 812 will collapse around the support 800. At this point, however, the support has effectively performed as expected.

As such, the tube 814 will effectively move closer to the end 831 as the surrounding filler material 822 is crushed by the load with the center support section 810*b* bearing additional weight of the load being applied without collapsing, thereby causing the upper and lower sections of the support 800 to yield first to maintain the tubes 814 and 820 in an open position. Because the tubes 814 and 820 remain open until the support 800 has completely or nearly completely yielded, a passage defined by the tubes 814 and 820 remains open for the passage of ventilation air and dust. This is particularly important as the supports reach the stage of yielding as shown in FIG. 22. That is, typically when the support 800 is no longer capable of yielding, the mine entry will eventually collapse around the support 800. Until complete collapse has occurred, however, even though the space between the roof 812 and floor 802 has significantly diminished and other nearby areas in the mine entry may have very well experienced some level of collapse, ventilation air can still pass through the tubes 814 and 820 of the support 800. In the case of a catastrophic and unpredicted mine roof collapse, if the supports of the present invention can continue to maintain air flow through the mine entry, the lives of any trapped miners can be saved since there is still some amount of ventilation air that can pass through the mine supports.

While the present invention has been described with reference to certain illustrative embodiments to illustrate what is believed to be the best mode of the invention, it is contemplated that upon review of the present invention, those of skill in the art will appreciate that various modifications and combinations may be made to the present embodiments without departing from the spirit and scope of the invention as recited in the claims. It should be noted that reference to the terms "shell", "tube" or "pipe" are intended to cover shells, tubes or pipes of all cross-sectional configurations including, without limitation, round, square, or other geometric shapes. In addition, reference herein to a use of the support in a mine entry or underground mine according to the present invention is not intended in any way to limit the usage of the support of the present invention. Indeed, the support of the present invention may have particular utility in various tunnel systems or other applications where a yieldable support post is desired. The claims provided herein are intended to cover such modifications and combinations and all equivalents thereof. Reference herein to specific details of the illustrated embodiments is by way of example and not by way of limitation.

Thus, aspects and applications of the invention presented here are described in the drawings and in the foregoing detailed description of the invention. Those of ordinary skill in the art will realize that the description of the present invention is illustrative only and not in any way limiting. Other embodiments of the invention will readily suggest themselves to such skilled persons including, without limitation, combinations of elements of the various embodiments. Various representative implementations of the present invention may be applied to any heating system.

Unless specifically noted, it is intended that the words and phrases in the specification and the claims be given their plain, ordinary, and accustomed meaning to those of ordinary skill in the applicable arts. It is noted that the inventor can be his own lexicographer. The inventor expressly elects, as his own lexicographer, to use the plain and ordinary meaning of terms in the specification and claims unless they clearly state otherwise in which case, the inventor will set forth the "special" definition of that term and explain how it differs from the plain and ordinary meaning. Absent such statements of the application of a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. § 112(f). Thus, the use of the words "function," "means" or "step" in the Detailed Description of the Invention or claims is not intended to somehow indicate a desire to invoke the special provisions of 35 U.S.C. § 112(f) to define the invention. To the contrary, if the provisions of 35 U.S.C. § 112(f) are sought to be invoked to define the inventions, the claims will specifically and expressly state the exact phrases "means for" or "step for" and the specific function (e.g., "means for heating"), without also reciting in such phrases any structure, material or act in support of the function. Thus, even when the claims recite a "means for . . . " or "step for . . . " if the claims also recite any structure, material or acts in support of that means or step, or that perform the recited function, then it is the clear intention of the inventor not to invoke the provisions of 35 U.S.C. § 112(f). Moreover, even if the provisions of 35 U.S.C. § 112(f) are invoked to define the claimed inventions, it is intended that the inventions not be limited only to the specific structure, material or acts that are described in the illustrated embodiments, but in addition, include any and all structures, materials or acts that perform the claimed function as described in alternative embodiments or forms of the invention, or that are well known present or later-developed, equivalent structures, material or acts for performing the claimed function.

What is claimed is:

1. A longitudinally yieldable support, comprising:

a first outer shell portion in the form of a column comprising a first outer wall portion and having a first longitudinal axis;

a second outer shell portion in the form of a column comprising a second outer wall portion and having a second longitudinal axis substantially aligned with the first longitudinal axis;

a third outer shell portion in the form of a column comprising a third outer wall portion and having a third longitudinal axis substantially aligned with the first and second longitudinal axes, the third outer shell portion interposed between the first and second outer shell portions so that the first, second and third outer shell portions are in a stacked arrangement, the third outer shell portion having an effective thickness of the third outer wall portion that is greater than first and second wall thicknesses of the first and second outer wall portions, respectively, the third outer shell portion defining a first pair of apertures located along the third outer wall portion, the first pair of apertures each positioned on opposite sides of the third outer shell portion from one another;

a first air ventilation tube having first and second ends attached to the third outer wall portion and extending transversely across the third outer shell portion at a location of and between the first pair of apertures to allow air to flow through the first pair of apertures and the first air ventilation tube; and a solid compressible filler material disposed within and substantially filling the first, second and third outer shell portions and encapsulating the first air ventilation tube within the third outer shell portion;

the third outer shell portion having a wall thickness sufficient to prevent the third outer shell portion from collapsing or yielding as at least one of the first or second outer shell portions and solid compressible filler material therein yield to prevent the first air ventilation tube from collapsing or yielding to maintain a flow of air through the first air ventilation tube as the at least one of the first or second outer shell portions and solid compressible filler material therein yield.

2. The support of claim 1, further comprising a fourth outer shell portion in the form of a column comprising a fourth outer wall portion and having a fourth longitudinal axis substantially aligned with the first and second longitudinal axes, the fourth outer shell portion interposed between the first and second outer shell portions so that the first, second, third and fourth outer shell portions are in a stacked arrangement, the fourth outer shell portion having an effective thickness of the fourth outer wall portion that is greater than the first and second wall thicknesses of the first and second outer wall portions, respectively, the fourth outer shell portion defining a second pair of apertures located along the fourth outer wall portion, the second pair of apertures each positioned on opposite sides of the fourth outer shell portion from one another and a second air ventilation tube having first and second ends attached to the fourth outer wall portion and extending transversely across the fourth outer shell portion at a location of and between the second pair of apertures to allow air to flow through the second pair of apertures and the second air ventilation tube.

3. The support of claim 2, wherein the first and second air ventilation tubes are arranged substantially in parallel.

4. The support of claim 2, wherein the third and fourth outer wall portions are integrally formed.

5. The support of claim 2, wherein the second air ventilation tube is welded at its first and second ends to the fourth outer shell portion proximate the second pair of apertures.

6. The support of claim 2, wherein the first air ventilation tube is positioned approximately one third an overall length of the support from a proximal end of the support and the second air ventilation tube is positioned approximately one third an overall length of the support from a distal end of the support.

7. The support of claim 1, wherein the first air ventilation tube is welded at its first and second ends to the third outer shell portion proximate the first pair of apertures.

8. The support of claim 1, wherein the first and second outer shell portions have substantially the same longitudinal length and the third outer shell portion is positioned approximately midway between a proximal end of the first outer shell portion and a distal end of the second outer shell portion.

9. The support of claim 1, wherein the support is capable of supporting a load of at least 100,000 lbs.

10. The support of claim 1, wherein the support is capable of supporting a load of between approximately 100,000 lbs and 300,000 lbs as the support yields under load without yielding the third outer shell portion.

11. The support of claim 10, wherein the first and second outer shell portions are configured to yield by folding upon themselves before the third outer shell portion yields.

12. The support of claim 1, wherein the first and second outer shell portions are integrally formed to form a first continuous outer shell and the third outer shell portion forms a sleeve around and is attached to the first continuous outer shell.

13. The support of claim 1, wherein the first outer shell portion is permanently attached to a first end of the third outer shell portion and the second outer shell portion is permanently attached to a second end of the third outer shell portion.

14. The support of claim 1, wherein the first, second and third outer shell portions are comprised of steel and wherein the solid compressible filler material is aerated concrete.

15. The support of claim 14, wherein the compressible filler material has a density of between about 50 and 60 $lb/ft^3$.

16. The support of claim 14, wherein the compressible filler material has a density of between about 40 and 50 $lb/ft^3$.

17. A longitudinally yieldable support for supporting a roof in an underground mine, comprising:

a first support section in the form of a column comprising a first outer shell of steel;

a second support section in the form of a column comprising a second outer shell of steel, the first and a second support sections being substantially the same in effective diameters and lengths;

a third support section in the form of a column comprising a third outer shell of steel interposed between and permanently attached to the first and second outer shells, the third outer shell defining at least one pair of apertures, each positioned on opposite sides of the third outer shell;

at least one air ventilation duct having first and second ends attached to the third outer shell at a location of the at least one pair of apertures, the at least one air ventilation duct transversely extending across the third outer shell between the first pair of apertures; and a solid compressible filler material substantially filling the first, second and third outer shells and substantially encapsulating the at least one air ventilation duct within the third outer shell;

the first air ventilation duct having a wall thickness sufficient to prevent the first air ventilation duct from collapsing or yielding as the first and/or second support sections and associated solid compressible filler material yield such that the first air ventilation duct does not collapse or yield to allow a flow of air through the first air ventilation duct as the support yields.

18. The support of claim 17, wherein the at least one pair of apertures comprises a first pair of apertures and a second pair of apertures formed in the third outer shell, the first pair of apertures being substantially vertically aligned with the second pair of apertures, each aperture of the respective first and second pair of apertures positioned on opposite sides of the third outer shell from one another, and further comprising a second air ventilation duct attached to the third outer shell between the second pair of apertures, the first and second air ventilation ducts welded at their respective ends to the third outer shell at locations of the first and second pair of apertures, respectively.

19. The support of claim 18, wherein the first air ventilation duct is positioned approximately one third an overall length of the support from a proximal end of the support and the second air ventilation duct is positioned approximately one third an overall length of the support from a distal end of the support.

20. The support of claim 17, wherein the compressible filler material has a density of between about 40 and 50 $lb/ft^3$.

21. The support of claim 20, wherein the first and second outer shells are configured to fold upon themselves as the support yields while the third outer shell does not yield.

22. The support of claim 17, wherein the compressible filler material has a density of between about 50 and 60 $lb/ft^3$.

23. The support of claim 17, wherein the support is capable of supporting a load of at least 100,000 lbs.

24. The support of claim 17, wherein the support is capable of supporting a load of between approximately 100,000 lbs and 300,000 lbs as the support yields under load without collapsing the at least one air ventilation duct.

* * * * *